US006093250A

United States Patent [19]

Salazar et al.

[11] Patent Number: 6,093,250

[45] Date of Patent: Jul. 25, 2000

[54] WET SCRUBBER AND PAINT SPRAY BOOTH INCLUDING THE WET SCRUBBER

[75] Inventors: Abraham J. Salazar; Kozo Saito; Richard P. Alloo, all of Lexington, Ky.; Naoji Tanaka, Toyota, Japan

[73] Assignees: University of Kentucky Research Foundation, Lexington; Toyota Motor Manufacturing, Erlanger, both of Ky.

[21] Appl. No.: 09/163,491

[22] Filed: Sep. 30, 1998

Related U.S. Application Data

[62] Division of application No. 09/105,092, Jun. 26, 1998.

[51] Int. Cl.[7] ..... B05B 15/12

[52] U.S. Cl. ..... 118/668; 118/326; 55/DIG. 46; 96/322; 454/49

[58] Field of Search ..... 118/326, 663, 118/668; 55/DIG. 46; 96/322; 454/49

[56] References Cited

U.S. PATENT DOCUMENTS

| | | | |
|---|---|---|---|
| 4,220,078 | 9/1980 | Walker et al. | 98/115 SB |
| 4,345,921 | 8/1982 | Gustavsson et al. | 55/223 |
| 4,350,506 | 9/1982 | Otto | 55/241 |
| 4,483,698 | 11/1994 | Kü chenthal et al. | 55/238 |
| 4,515,073 | 5/1985 | Dorsch et al. | 98/115.2 |
| 4,521,227 | 6/1985 | Gerdes et al. | 55/225 |
| 4,608,064 | 8/1986 | Napadow | 55/238 |
| 4,664,060 | 5/1987 | Roberts | 118/326 |
| 4,700,615 | 10/1987 | Napadow | 98/115.2 |
| 4,704,952 | 11/1987 | Johnson et al. | 98/115.2 |
| 4,750,412 | 6/1988 | Itou | 98/115.2 |
| 4,885,010 | 12/1989 | Rich et al. | 55/241 |
| 5,020,470 | 6/1991 | West et al. | 118/326 |
| 5,040,482 | 8/1991 | McGuire et al. | 118/326 |
| 5,074,238 | 12/1991 | Telchuk et al. | 118/326 |
| 5,100,442 | 3/1992 | Gore et al. | 55/240 |
| 5,817,575 | 10/1998 | Han | 438/680 |
| 5,851,293 | 12/1998 | Lane et al. | 118/715 |
| 5,855,509 | 1/1999 | White et al. | 454/52 |

FOREIGN PATENT DOCUMENTS

| | | |
|---|---|---|
| 11 57 977 | 11/1963 | Germany . |
| 28 00 688 | 7/1979 | Germany . |
| 1 469 712 | 4/1977 | United Kingdom . |

OTHER PUBLICATIONS

PCT Invitation to Pay Additional Fees including Annex, dated Oct. 15, 1999 (4 pages).

Patents Abstracts of Japan, vol. 010, No. 328 (C–383), Nov. 7, 1986.

PCT International Search Report dated Jan. 7, 2000 (6 pages).

*Primary Examiner*—James Sells

*Attorney, Agent, or Firm*—Finnegan, Henderson, Farabow, Garrett & Dunner, L.L.P.

[57] ABSTRACT

A wet scrubber including an acceleration cone for accelerating an airflow containing paint particles and having a curved inner wall on which water used for capturing paint particles flows downwardly, a mixing chamber for mixing the airflow and water and provided with an impingement pool on which the airflow impacts, a vortex chamber for creating a swirling flow of air and water that further aids the capture of paint particles, and a discharge volute communicating with the vortex chamber and provided with an enlarged discharge port for discharging the air and water. The wet scrubber is used in a paint spray booth, and provides the advantages of reduction in both energy consumption and noise and improvement in the efficiency of the capturing of paint particles.

22 Claims, 13 Drawing Sheets

WET SCRUBBER AND PAINT SPRAY BOOTH INCLUDING THE WET SCRUBBER

This is a divisional application of pending application Ser. No. 09/105,092 filed Jun. 26, 1998.

BACKGROUND OF THE INVENTION

1. Field of the Invention

The present invention relates to a wet scrubber which captures and scrubs liquid or solid particles contained in an airflow, and also to a paint spray booth comprising the wet scrubber and capable of capturing and scrubbing paint particles contained in a contaminated airflow discharged from the spray booth.

2. Description of the Related Art

Typically, painting of various kinds of mass-produced products such as car bodies and car parts is carried out in a paint spray booth, in which an object to be painted is sprayed with paint utilizing spray painting equipment. Paint that does not stick to the object to be painted floats in the air as paint mist. During the operation of such paint spray booths, it is necessary to supply continuously fresh outside air to, and to remove the paint mist from, the working area by means of a discharge air managing system. These serve the purposes of maintaining a safe and healthy working environment and assuring the highest quality of paint finish. The paint particles contained in this discharge air must be captured before the airflow exits to the atmosphere to avoid environmental pollution.

There are two known methods for separating paint mist from the air exhaust stream: i) a dry method in which the contaminated airflow is made to pass through a dry filter or screen and the paint particles contained therein are adsorbed or trapped by the filter or the like; and ii) a wet method in which the contaminated airflow is put in contact with and mixed with a liquid, such as water, such that the paint particles contained therein are captured and scrubbed by the liquid. Conventionally, in a paint spray facility for painting large products such as cars, the wet method is adopted.

There are various kinds of wet methods for separating paint mist. Typically, the following known methods and means are utilized:

1. A method in which, utilizing gravity difference between the airflow and the liquid such as water, the airflow is made to pass through the bulk liquid to capture paint particles contained in the airflow;
2. A method in which the liquid such as water is made to spill downwardly, and the airflow is made to pass through a liquid film formed thereby, to capture in the film paint particles contained in the airflow;
3. A method in which the liquid such as water is sprayed to create a large population of liquid drops and the contaminated airflow is made to pass through this liquid mist where the liquid drops contact and capture the paint particles to be removed;
4. A method in which the airflow and the liquid such as water are made to pass through a restriction called a venturi. The turbulence of high-velocity air in the venturi causes break-up of the liquid into small drops that intercept and coalesce with the entrained paint particles; and
5. A method in which the liquid such as water is made to flow downwardly on a plate or the like and the airflow is made to blow on the plate, or, the airflow is made to impinge upon a pool of liquid such as water. The paint particles contained in the air stream having greater momentum impact and are trapped on the surface of the liquid.

Typically, a discharge airflow from a paint spray booth consists of an airflow containing a paint mist that includes paint particles of various diameters. The diameters of these paint particles range from several hundred sum to less than 1 $\mu$m. In a typical paint mist, there are more small paint particles than large paint particles.

In conventional wet scrubbers used with a paint spray booth of a car assembly plant, an attempt has been made to improve scrubbing efficiency by increasing the frequency and the speed of the impacts of the discharge air stream flowing from the spray section against a capturing water flow. In this connection, U.S. Pat. Nos. 5,074,238, 5,040,482, 4,700,615, 4,664,060, 4,220,078, and the like disclose various proposals. U.S. Pat. No. 5,074,238 discloses a scrubber having a venturi opening through which a discharge airflow and water pass and a curved baffle where air and water mix. U.S. Pat. No. 5,040,482 discloses a scrubber having two troughs, which supply a sheet of water along an inclined surface and a baffle to intermix the water and paint-laden air. U.S. Pat. No. 4,700,615 discloses a scrubber in which several pools are provided hierarchically such that water runs through the pools in sequence, and a discharge airflow is made to pass through the plurality of water curtains that are formed. U.S. Pat. No. 4,664,060 discloses a scrubber in which a lip is provided in the rectangular venturi to increase the intermixing of the air and water, and a baffle plate is disposed below the venturi throat. U.S. Pat. No. 4,220,078 discloses a scrubber with a V-shaped impingement member disposed in the path of a discharge air-paint flow, and a shroud is provided around the collision to effect further scrubbing.

It has been found that attempts to scrub paint particles more efficiently tend to cause increased processing noise. Also, the necessity of increasing the capacity of an exhaust air fan or the like tends to increase equipment cost and energy consumption. Therefore, a device is needed that not only improves efficiency but also reduces noise and energy consumption as much as possible. Reduction of noise is desired from the standpoint of improving the working environment of an operator. U.S. Pat. No. 5,100,442 discloses a scrubber in which a discharge airflow and a water flow are directed into a venturi. Then, they are introduced into a restriction that defines a noise barrier that prevents noise caused by turbulent mixing to pass upstream. U.S. Pat. No. 5,020,470 discloses a scrubber having an elongated discharge tube through which discharge air and water flow. Particulate is removed by virtue of impact of the airflow with an impact pool. Little or no water dispersal or atomization occurs near the top of the discharge tube, and noise is abated. U.S. Pat. No. 4,515,073 discloses a scrubber having a serpentine path in which the air passes through the scrubbing fluid spray several times. A sound absorber is provided within baffles to reduce impact noise. U.S. Pat. No. 4,350,506 discloses a scrubber with a bell-shaped venturi portion that has an enlarged middle and a sound absorber is provided therein. U.S. Pat. No. 4,345,921 discloses a scrubber in which a pair of guide plates is provided in a venturi above the throat to form noise-muffling zones. An impact plate is positioned below the venturi throat and can contain a film or pool of water.

In certain prior-art scrubbers, a portion of the discharge airflow can pass outside the scrubber with little or no mixing with water, and thus can still contain paint particles. Further, the splash of water at a pool can cause contaminated water drops to be discharged with the air via the exhaust air fan. A device to change the direction of the discharge airflow for the purpose of enhancing the scrubbing of paint particles from a paint mist has been proposed in U.S. Pat. No. 4,704,952, for example. This patent discloses a scrubber having structures through which paint-laden air and water flow downwardly and mix together. Partitions outside the structures cause the air to turn abruptly upwardly and then reverse lateral direction. The air passes through baffles and then is discharged into the atmosphere.

Although the prior art discloses many wet scrubbers, there still remains room for improvement. For example, in some conventional wet scrubbers, there are corners and edges, uneven portions, and the like in the path through which air flows and where the air stream is mixed with the water. This results in unnecessary pressure loss, waste of energy, and increased noise. Further, some conventional wet scrubbers still have low efficiency when capturing very small paint particles in water, still present the problem of allowing part of the paint mist to be discharged to the environment, and still permit a large amount of paint-laden water drops to be discharged through the air fan device to the atmosphere.

SUMMARY OF THE INVENTION

Accordingly, an objective of the present invention is to provide a wet scrubber in which pressure loss is minimized, energy consumption is reduced, reduction of the scrubber size is made possible, and noise level is remarkably reduced. The result is a wet scrubber which is improved with regard to equipment construction, operating cost, and quality of working environment.

Another objective of the present invention is to provide a wet scrubber that makes it possible for particles contained in the airflow to be resident for an extended time in the capturing device. This feature increases the opportunity and frequency of collision between the paint particles and the scrubbing liquid, whereby the capturing efficiency and the performance of the scrubber is improved.

A further objective of the present invention is to provide a paint spray booth having one or more wet scrubbers that can be operated, maintained and adjusted independently, and in which paint particles contained in the airflow can be separated and scrubbed more efficiently, and energy consumption and noise are significantly reduced.

Other objectives of the present invention will be set forth in part in the following description, and in part will be obvious from the description, or may be learned by practice of the invention.

To achieve the objectives and in accordance with the purpose of the invention, as embodied and broadly described herein, the wet scrubber of the present invention comprises an acceleration cone having an inlet for receiving the discharge airflow and water to be used in capturing paint particles, and an outlet, a mixing chamber positioned below and in communication with the outlet of the cone for mixing the accelerated discharge airflow with water, a vortex chamber positioned adjacent to and in communication with the mixing chamber, for generating a swirling rotational mix of discharge air and water within the wet scrubber, and a discharge port for air and water.

To further achieve the objectives and in accordance with the purpose of the invention, as embodied and described herein, the wet scrubber of the present invention further comprises an acceleration cone through which a discharge airflow passes and is accelerated, the acceleration cone having an inlet and an outlet and a curved inner peripheral wall surrounding a passage of decreasing cross-section from the inlet to the outlet, the inner peripheral wall having a surface on which liquid for capturing particles can run down from the edge of the inlet to the edge of the outlet, a mixing chamber, in communication with the acceleration cone, provided with an impingement pool for holding liquid, and having a surface below the outlet of the acceleration cone such that the discharge airflow is directed upon and impacts the liquid in the pool and mixes with this liquid in the pool and the liquid falling from the edge of the cone outlet, a vortex chamber, connected to and in communication with the mixing chamber, for causing the airflow and liquid mixture to circulate, the vortex chamber having a cylindrical shape with an inner wall surface connecting with the surface of the mixing chamber and on which liquid flows when the airflow and liquid mixture circulates, and a discharge volute in communication with the vortex chamber for discharging the airflow and liquid after deceleration thereof, and having an inner wall surface that communicates with the inner wall surface of the vortex chamber and an enlarged discharge port.

An additional aspect of the present invention includes a residence cylinder connected between the vortex chamber and the discharge volute, for sustaining the swirling flow, the residence cylinder having an inner wall surface that communicates with the inner wall surface of the vortex chamber and the discharge volute and on which liquid flows when the airflow and liquid mixture circulates.

As an additional aspect of the present invention, a pair of vortex chambers, a pair of residence cylinders, and a pair of discharge volutes are preferably provided so that the scrubber is symmetrical in operation.

A further aspect of the present invention is the incorporation of a paint spray booth having a spray section for spray painting of an object, a scrubber section located below the spray section and a flow plate, located between the spray and scrubber sections, having an opening provided at the upper portion thereof, a wet scrubber as broadly recited above mounted in the scrubber section with the acceleration cone fitting in the opening in the flow plate, a liquid supply means for supplying liquid to the flow plate and from there to the inner peripheral wall of the acceleration cone of the wet scrubber, and an exhaust mechanism for drawing through the wet scrubber discharge air from the spray section containing paint particles to be scrubbed. A paint spray booth according to the present invention can be provided with a plurality of wet scrubbers spaced at substantially regular intervals in the longitudinal direction of the scrubber section, and preferably are operated, maintained, and adjusted independently of one another.

A still further aspect of the wet scrubber of the present invention is the provision of an enclosed exhaust air chamber positioned below and in communication with the discharge volutes for collecting airflow flowing out of the discharge volutes and directing this airflow to an exhaust air duct, and a drain for liquid laden with trapped paint particles flowing out of the discharge volutes, the drain positioned at the bottom of the exhaust air chamber.

To further achieve the objectives and in accordance with the purpose of the invention, as embodied and described herein in its broadest aspect, the wet scrubber of the present invention comprises a cone through which discharge airflow passes, the cone having an inlet and an outlet, the inner surface of the cone being shaped to provide a uniform flow velocity across its outlet, and the inner surface providing a flow path from the inlet to the outlet for liquid used for capturing particles, a vortex chamber in communication with the cone for mixing and circulating the airflow and the liquid and having an inner wall surface on which the liquid flows when the airflow and the liquid circulate, and a discharge volute in communication with the vortex chamber for discharging the airflow and liquid after deceleration thereof.

DETAILED DESCRIPTION OF THE PREFERRED EMBODIMENTS

The present invention will now be explained in detail by describing embodiments with reference to the drawings-embodiments that include the best mode for carrying out the present invention.

Figure 1:
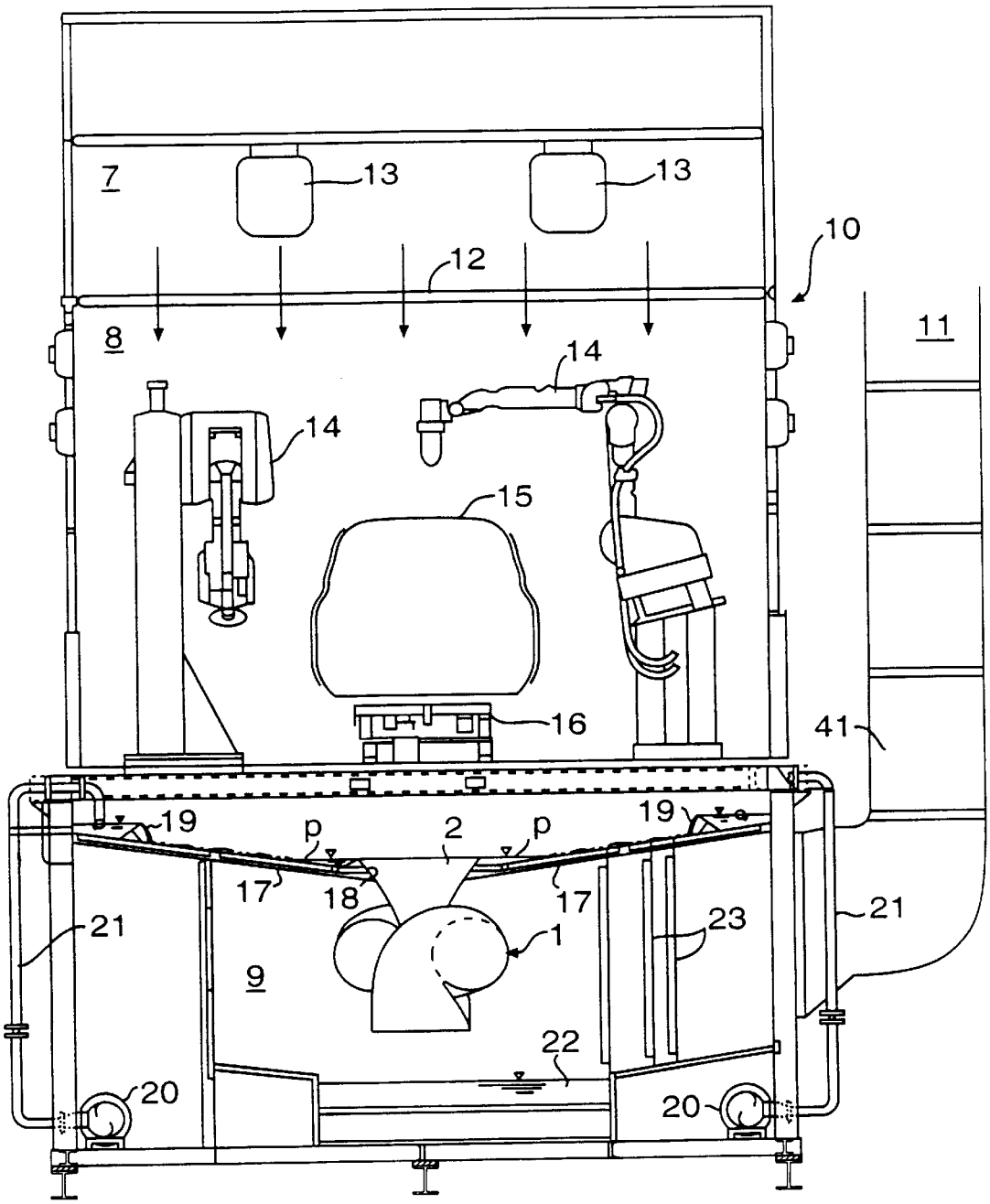
FIG. 1 is a schematic view of the inside of a paint spray booth in accordance with a first embodiment of the present invention.

FIG. 1 illustrates the inside of a paint spray booth 10 for use in spray painting car bodies in a car factory. The booth 10 is divided into three smaller sections: an air charging section 7 at the top, a spray section 8 in the middle, and a scrubber section 9 at the bottom. The booth 10 is connected to an exhaust air duct 41 which leads to an exhaust air fan mechanism 11 (not shown).

The air charging section 7 has a filter 12, which fits tightly between this section and the spray section 8. Bug filters 13 are also provided. After bugs and dust are removed from the air by the bug filter 13 and the filter 12, the temperature-controlled and humidity-controlled air is supplied to the spray section 8 as a vertically downward airflow.

In the spray section 8, robots 14 or other apparatus for automatically spray painting a vehicle body 15 are typically disposed on the right side and the left side of a path along which the vehicle body 15 is conveyed on a carriage 16. During painting, excessive paint that does not stick to the vehicle body 15 floats in the air as paint mist.

Figure 2:
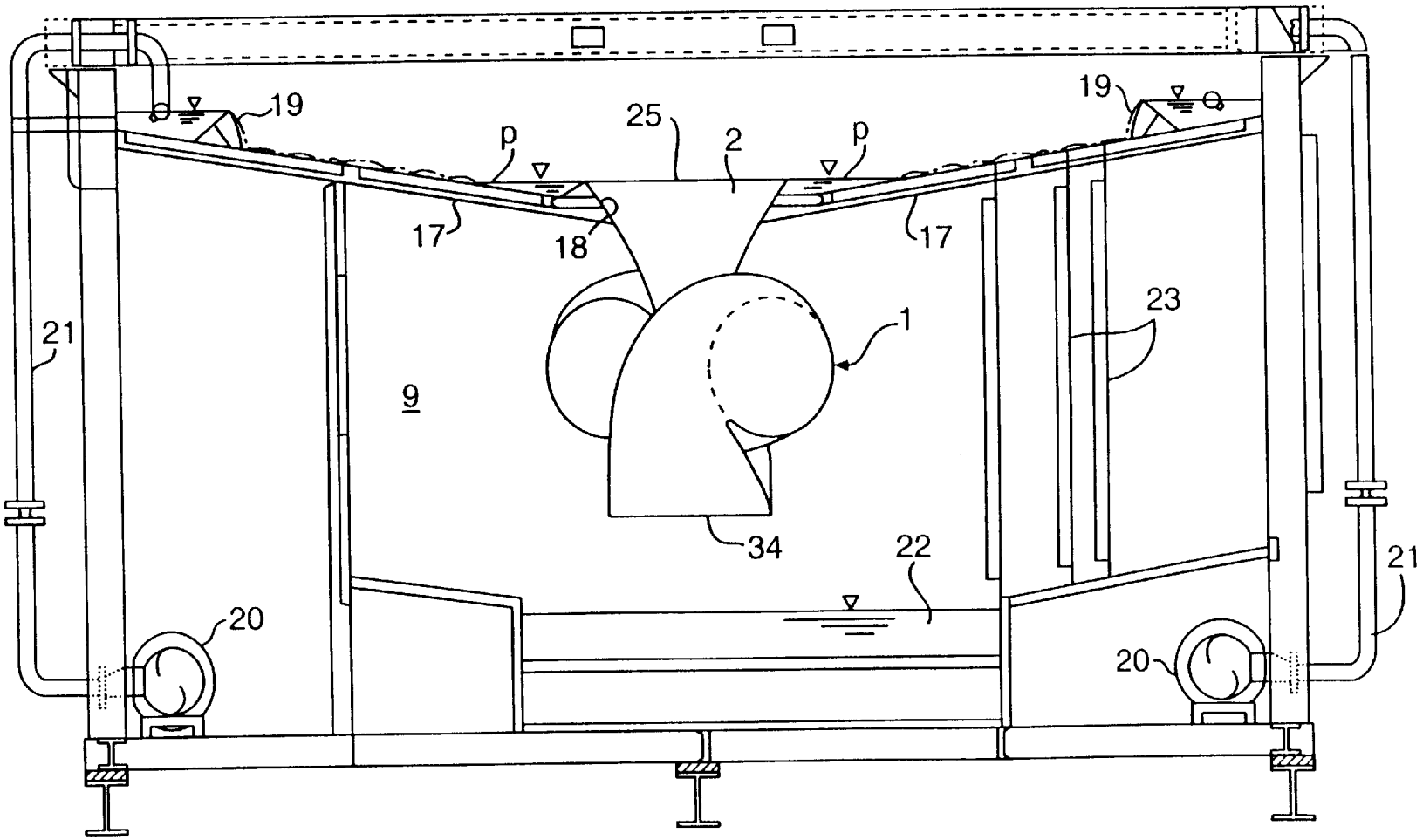
FIG. 2 is an enlarged view of the inside of the scrubber section of the paint spray booth shown in FIG. 1.

As shown in an enlarged illustration of a scrubber section 9 in FIG. 2, a flow plate 17 is tightly fitted above the scrubber section 9. A wet scrubber 1 according to the present invention is mounted so that its acceleration cone 2 closely fits in an opening 18 formed in the middle of the flow plate. Therefore, air in the spray section 8 (including paint mist) is drawn by operation of the exhaust air fan mechanism 11 (not shown) and is introduced into the wet scrubber 1 as a downwardly directed discharge airflow. Wet scrubber 1 is used for capturing and scrubbing paint particles contained in the discharge airflow from the spray section 8.

Gutters 19 are provided on the right side and the left side of the flow plate 17. Water supply pipes 21 extending from pumps 20 introduce water into the right and left gutters 19 to overflowing. Water p, which overflows the gutters 19, runs down the right side and the left side of the flow plate 17 where it preferably forms a shallow pool. From here, water p flows into the entire upper periphery or edge of the inlet of the acceleration cone 2 of the wet scrubber 1 and serves as liquid for capturing paint particles and as a mean of protecting the inner surface of the acceleration cone from paint accumulation, as later described.

The scrubber section 9 communicates with the exhaust air fan mechanism 11 via an exhaust air duct 41 (FIG. 1). A drain 22 in which the paint-laden water discharged from the wet scrubber 1 gathers is positioned at the bottom of the scrubber section 9. Several mist separators 23 are attached in the paths of the airflow that communicate with the exhaust air fan mechanism 11. Preferably, a plurality (not shown) of wet scrubbers 1 is provided at substantially regular intervals (for example 1.5–3.0 m) in the longitudinal direction of the scrubber section 9 of the paint spray booth 10, i.e., in the same direction as the path along which a vehicle body 15 is conveyed.

Embodiment 1

Figure 3:
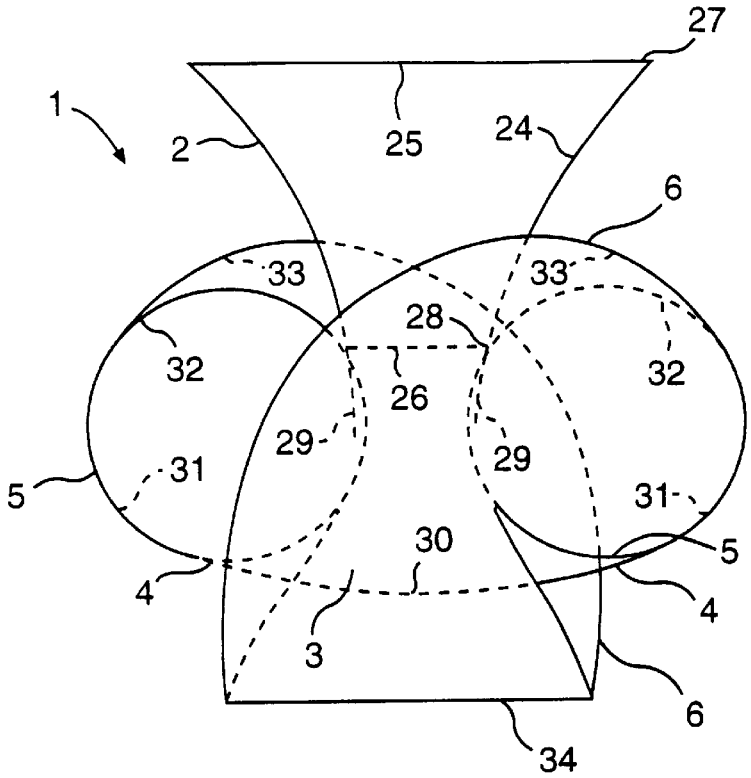
FIG. 3 is a front elevation view of a wet scrubber in accordance with a first embodiment of the present invention.
Figure 4:
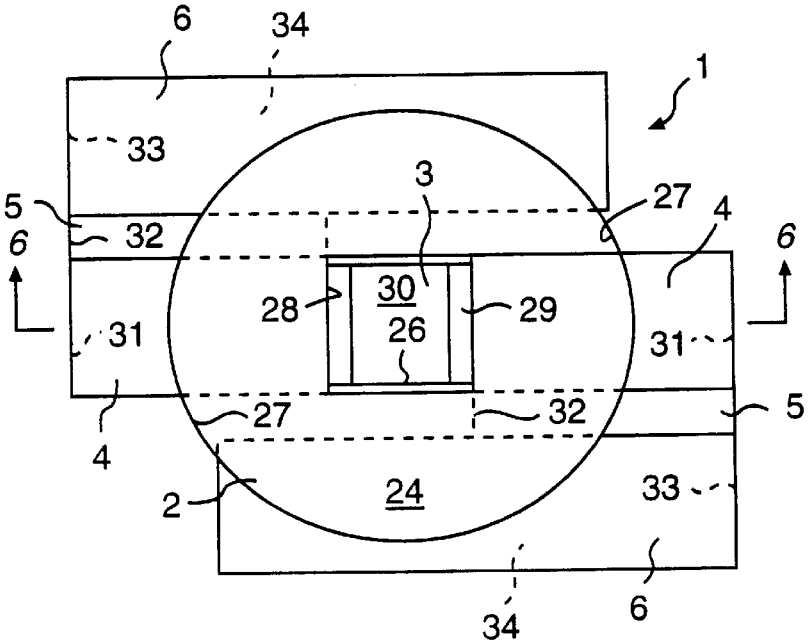
FIG. 4 is a plan view of the wet scrubber shown in FIG. 3.
Figure 5:
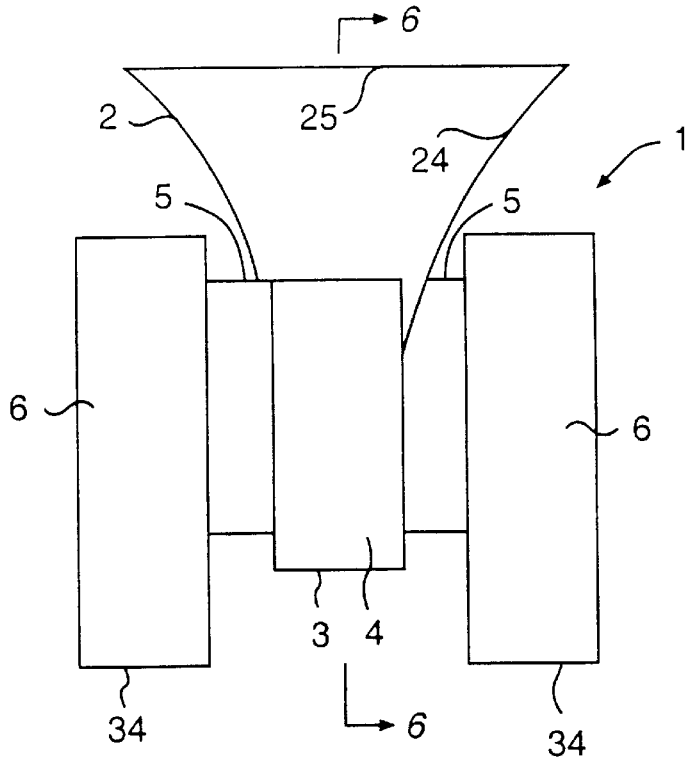
FIG. 5 is a side elevation view of the wet scrubber shown in FIG. 3.
Figure 6:
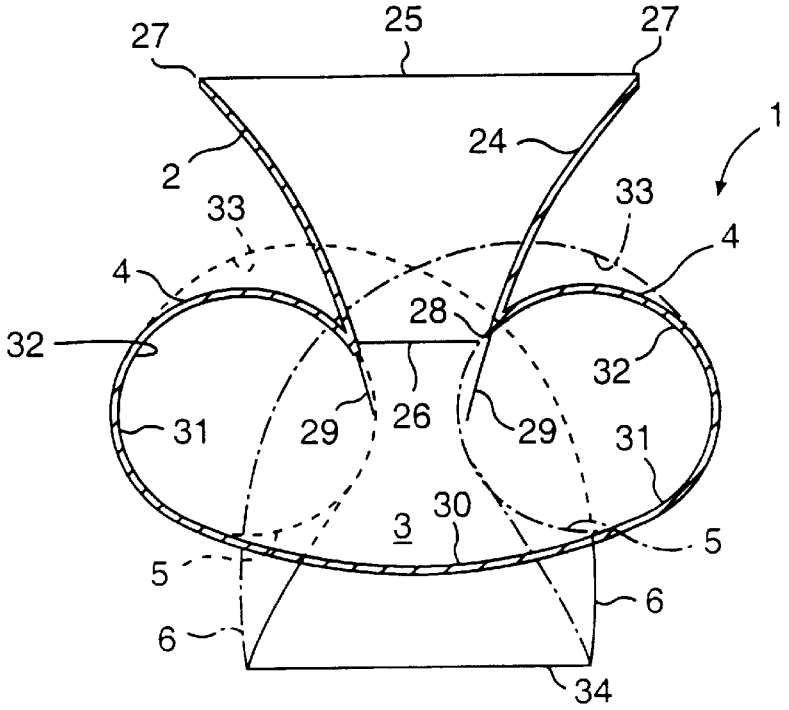
FIG. 6 is a sectional view of the wet scrubber taking along line 6—6 of FIGS. 4 and 5.

FIGS. 3, 4, and 5 are a front elevation, a plan view, and a side elevation, respectively, of the wet scrubber 1 constructed in accordance with the first embodiment of the present invention. FIG. 6 illustrates a cross section of the inside of the wet scrubber 1 taking along the line 6—6 of FIG. 4 or FIG. 5. In accordance with the invention, the wet scrubber 1 is formed of the acceleration cone 2, a mixing chamber 3, vortex chambers 4, residence cylinders 5, and discharge volutes 6. The vortex chambers 4, the residence cylinders 5, and the discharge volutes 6 are embodied here as symmetrical pairs.

As embodied herein, the acceleration cone 2 has a rounded or curved inner peripheral wall 24. The opening or passage through the acceleration cone 2 has a decreasing cross section from a circular inlet 25 at an upper end to a rectangular (square shape shown) outlet 26 at a lower end, and is shaped similarly to a funnel. Therefore, as the discharge airflow (shown as arrows e in FIG. 9) passes down through the acceleration cone 2, the speed of the downwardly directed airflow increases. Air flowing in a region closer to the inner peripheral wall of the cone is accelerated more than air flowing closer to the center line of the cone such that the discharge airflow as a whole exits the outlet 26 at a substantially uniform speed over the entire outlet cross section.

Figure 7:
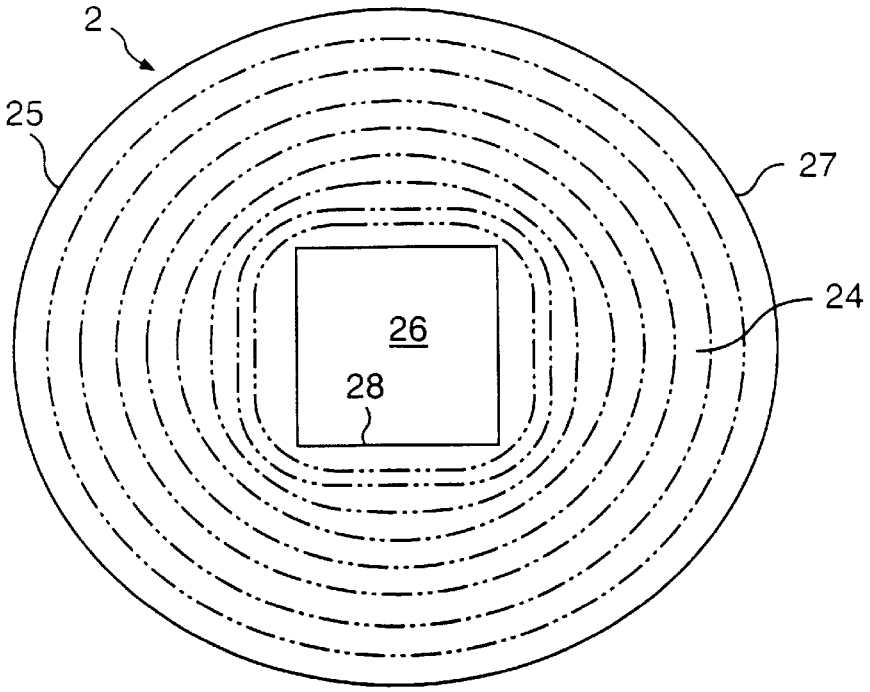
FIG. 7 is a plan view of an acceleration cone of the wet scrubber shown in FIG. 3.
Figure 8:
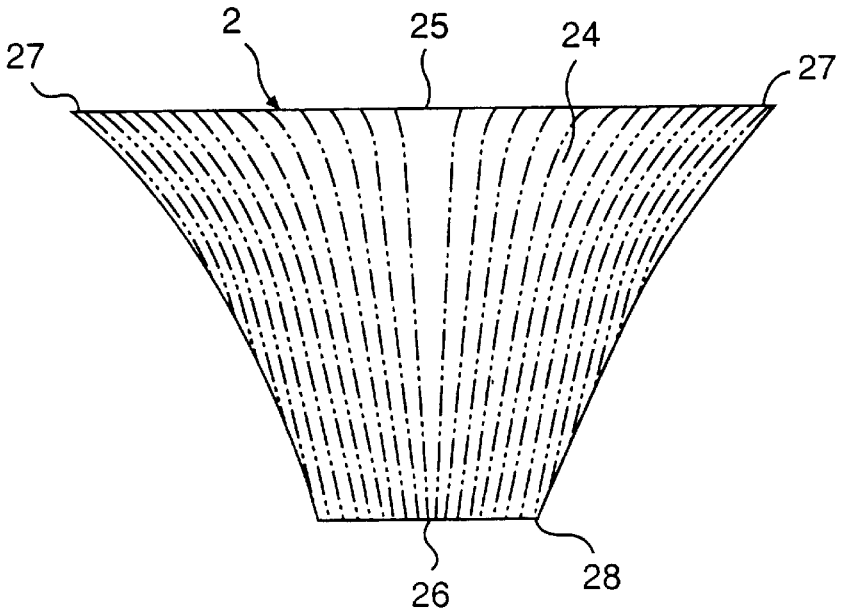
FIG. 8 is a front elevation view of the acceleration cone shown in FIG. 7.

In the present embodiment, the inner peripheral wall 24 shown in detail in FIGS. 7 and 8, has no comers but does have a multidimensional curved surface, and the speed of the airflow discharged from the outlet 26 at the lower end of the cone (shown as arrows e' in FIG. 9) is as stated above substantially uniform over the entire cross section of the outlet 26. The smooth acceleration of the flow through the acceleration cone 2 of the present embodiment can reduce to the minimum the pressure loss required to achieve an airflow speed suitable for capturing and can substantially reduce noise. The design of the multidimensional curved surface of the cone is calculated based on the size (cross section) of the inlet 25 of the acceleration cone 2, the size (cross section) of the outlet 26, and the height of the acceleration cone 2 (the distance between the inlet 25 at the upper end and the outlet 26 at the lower end), such that, as an example, the airflow at the outlet 26 of the acceleration cone 2 may be at an even speed of 15 to 40 m/s over the whole cross section of the outlet 26.

Figure 9:
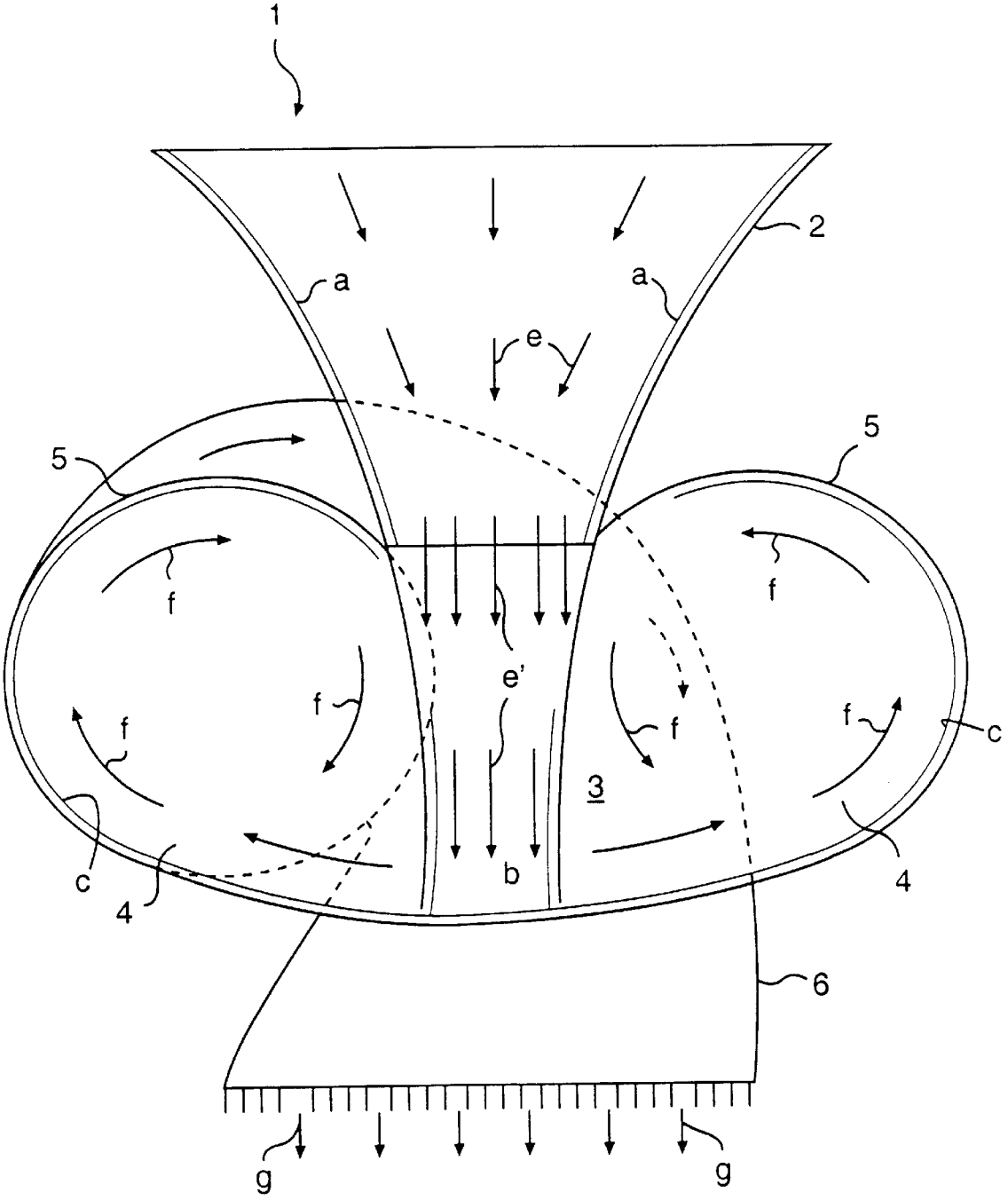
FIG. 9 is a schematic view of the front elevation of the wet scrubber shown in FIG. 3 to explain how the process of capturing particles entrained in the discharge airflow occurs.

The water p used for capturing particles and protecting the inner cone surface enters the inlet 25 around the entire inner peripheral edge 27 and runs evenly down the surface of the inner peripheral wall 24. In FIG. 9, the letter a designates a water film formed on and flowing down the surface of the inner peripheral wall 24. The discharge airflow (shown as the arrows e) and the water film a are introduced together from the outlet 26 into the mixing chamber 3. Note that the outlet 26 of the acceleration cone is embodied as a square or a rectangle in general—a convenience for attaching a pair of nozzle adjusting plates 29.

In accordance with the invention, a mixing chamber is provided which is connected to and communicates with the acceleration cone. As embodied herein, mixing chamber 3 contains an impingement pool 30 positioned directly below the outlet 26 of the acceleration cone 2 so that water accumulated in the impingement pool is impacted by the discharge airflow. The impingement pool 30 is formed using a part of a circular surface, an oval surface, or other similar surface, and is structured such that not only is water pooled thereon, but also the discharge airflow e' (FIG. 9) is directed upon and impacts this water. Thus, in the inside space of the mixing chamber 3, the discharge airflow gushes downwardly at substantially uniform speed out from the outlet 26 of the acceleration cone 2 and the pair of nozzle adjusting plates 29. At the same time, the water film a in FIG. 9 forms now a curtain-like water flow (designated as b in FIG. 9) as it falls from the inner peripheral edge 28 of the outlet 26 and the adjusting plates 29 toward the impingement pool 30. The discharge airflow e' violently impacts against and is mixed with the water in the impingement pool 30 and also with the water in the water curtain b.

In the present invention, a pair of nozzle adjusting plates 29 are mounted opposed to each other and attached to the outlet 26 of the acceleration cone 2. These plates 29 are made adjustable so that they can be tilted inwardly or outwardly to change the cross section of the flow after the outlet 26 of the acceleration cone 2. By increasing or decreasing the cross section around the outlet 26 by movement of the pair of nozzle adjusting plates 29, the speed of the air jet directed toward the impingement pool 30 can be selectively controlled. By adjusting the speed of the air jet according to the volume of discharge airflow and the concentration of paint particles in it, these nozzle adjusters 29 allow the discharge airflow to collide more efficiently with and mix with the water present in the mixing chamber 3.

In accordance with the invention, vortex chambers are connected to and communicate with the interior space of the mixing chamber. As embodied herein, two vortex chambers 4 are provided, one on the left and the other on the right of the mixing chamber 3, and both have an inner wall surface 31 of cylindrical shape. Further, the respective inner wall surfaces 31 connect with the surface of the impingement pool 30 of the mixing chamber 3. Thus, the discharge airflow e' (FIG. 9) after impacting and mixing with the water at the bottom of the mixing chamber 3 is directed toward the vortex chambers 4 where it passes through the water curtain b to mix further with the water. Upon entering chambers 4, the air/water mixture begins to circulate. The vortex chambers 4 are essentially chambers where a whirling circular motion of the flow is created. Due to the effect of inertia, when the airflow e' collides with the liquid curtain b, the energy is directly converted to and utilized as the energy for the air and water mixture to form vortices f with little damping. Accordingly, the pressure loss at this stage where the discharge airflow and water mixture moves from the mixing chamber 3 to the vortex chambers 4 to form vortices f is minimized.

The vortices f make the heavier particles of various kinds contained in the swirling airflow, i.e., paint particles, water drops and the like, migrate to the periphery of the vortex chamber 4 where the particles contact one another, coalesce to form bigger particles and mix further with the water. As a result, capturing of the paint particles by the water is further facilitated. In addition, the vortices f allow the paint particles contained therein to reside for an extended time in the vortex chambers 4, where the opportunity and frequency of contacting the trapping water increases.

In particular, due to the centrifugal force exerted over the mixed stream in the vortices f, water droplets of larger specific gravity are forced from the core of the vortex chambers 4 toward the inner walls 31. Thus, a part of the water flows on the inner wall surfaces 31 of the vortex chambers 4 urged along by the vortices f. At the same time, because paint particles and the like contained in the swirling flow have a very large specific gravity, they also migrate toward the periphery of the vortex chambers 4 to contact and be captured in the water film (designated as c in FIG. 9) flowing on the inner wall surfaces 31. Therefore, capturing of the paint particles originally contained in the discharge airflow by the water film c increasingly occurs. Moreover, the high-speed water film on the inner wall surfaces 31 of the vortex chambers 4 prevents contained paint particles from attaching to these inner wall surfaces 31, and the insides of the vortex chambers 4 are kept clean over a reasonable time without the need for special cleaning. In addition, the swirling airflow in the vortices f effectively inhibits the discharge airflow from veering off toward the exhaust air fan device without being sufficiently mixed with the water. In this respect, because the vortex chambers 4 communicate with the air-liquid mixing space in the mixing chamber 3, water droplets generated by the splashing of the liquid curtain b (FIG. 9) are prevented from escaping the scrubber because they are always circulated in chambers 4 before exiting to the exhaust air system.

In accordance with the invention, residence cylinders are connected between and communicate with the vortex chambers and discharge volutes. As embodied herein, there are two residence cylinders 5, one on the left side and the other on the right side of the scrubber 1. Due to their inner cylindrical shape, the residence cylinders 5 can maintain the swirling flow for an extended period of time. As a result, the swirling discharge airflow mixed with the water remains resident in the cylinders 5, and the opportunity and frequency of making particles (paint particles and water droplets) contained in the discharge airflow contact one another is increased, and thus, the capturing of paint particles by the water is enhanced further.

Each inner wall surfaces 32 of a residence cylinder 5 has, at the portion communicating with its respective vortex chamber 4, a curvature corresponding in part to that of the inner wall surface 31 of the vortex chamber 4, and, at the portion communicating with its respective discharge volute 6, a curvature corresponding in part to that of inner wall surface 33 of the discharge volute 6. Accordingly, the inner wall surfaces 31 of the vortex chambers 4 and the inner wall surfaces 33 of the discharge volutes 6 are positioned to be in perfect alignment via the inner wall surfaces 32, and provide substantially unimpeded continuity to the flow path of the swirling flow. Therefore, the pressure loss at this stage as the swirling fluids f proceed from the vortex chambers 4 to the discharge volutes 6 is again minimized.

In accordance with the invention, discharge volutes are provided in communication with the vortex chambers and the residence cylinders. As embodied herein, there are two discharge volutes 6, one on the left side and the other on the right side of scrubber 1. The volutes have a spiral shape and a continuously increasing cross-section in the direction of discharge. Both volutes 6 are provided with an enlarged discharge port 34 facing downward.

As shown in FIGS. 3 to 6, the discharge volutes 6 are provided with their inner wall surfaces 33 having a smooth spiral shape to further reduce pressure loss. The swirling flow introduced into the discharge volutes 6 from the vortex chambers 4 and the residence cylinders 5 is discharged downwardly out of the scrubber 1, after being sufficiently decelerated in the volutes 6 preferably to a speed of about 10 m/s or less (shown by arrows g in FIG. 9). Static pressure is thus recovered by the amount of reduction in dynamic pressure. Accordingly, the pressure loss at this stage where the swirling air currents (now significantly cleaned of paint particles) are discharged to the exhaust air system is again minimized. The water (containing a large amount of trapped paint particles) that was flowing at high speed on the inner wall surfaces 31 of the vortex chambers 4 and on the inner wall surfaces 32 of the residence cylinders 5, runs along the surfaces 33 of volutes 6, is decelerated and subsequently discharged with the cleaned air downwardly through the discharge ports 34. The water charged with paint particles is then collected in a drain path 22 (FIGS. 1 and 2).

Although the operation of wet scrubber 1 has been to a major extent described in the above description, it will now be summarized with reference to FIG. 9. The discharge airflow e containing paint particles is accelerated as it passes through the acceleration cone 2 and is discharged at substantially uniform speed from the outlet 26 (the arrows e'). Next, in the mixing chamber 3, the airflow e' violently impacts upon and is mixed with the water pool fed by the water curtain b flowing from the acceleration cone 2. The airflow is now directed through this water curtain to the right and left vortex chambers 4 with the pressure loss kept to a minimum. In the vortex chambers 4, the discharge air stream mixed with the water form vortices (arrows f) which facilitate further contact of the paint particles with the water. Next, the discharge air currents mixed with the water are introduced to the right and left residence cylinders 5 where the vortices (arrows f) are maintained and paint particles continue the frequent contact with water. After that, the discharge airflows mixed with the water are decelerated in the right and left discharge volutes 6, and then are discharged as gentle flows (arrows g) from the downward ports 34 together with the water which exits primarily from the inner surfaces of volutes 6. Prior to discharge, the paint particles in the air continue to make contact with the water. There are thus at least five opportunities in scrubber 1 for paint particles to be scrubbed from the airflow by the capturing water. The end result is that the water exiting the volutes is loaded with trapped paint particles while the airflow is substantially free of paint particles.

In the structure of the present wet scrubber 1, the inner peripheral wall 24 of the acceleration cone 2 has no corners, the impingement pool 30 and the inner wall surfaces 31, 32, 33 communicate with one another, an enlarged discharge port 34 is provided, and the pressure loss of the discharge airflow passing through the scrubber is kept to the minimum. Accordingly, in the present wet scrubber 1, energy consumption is decreased and noise level is reduced. Further, in the present wet scrubber. 1, the discharge airflow is mixed with the water by impacting against the water pool and passing through the water curtain b in the mixing booth 3, and by contact with the water for an extended period of time in the vortices f in the vortex chambers 4 and residence cylinders 5. Accordingly, the present wet scrubber 1 provides an improved structure, based upon the efficiency of capturing and scrubbing of paint particles contained in the discharge airflow.

Figure 10:
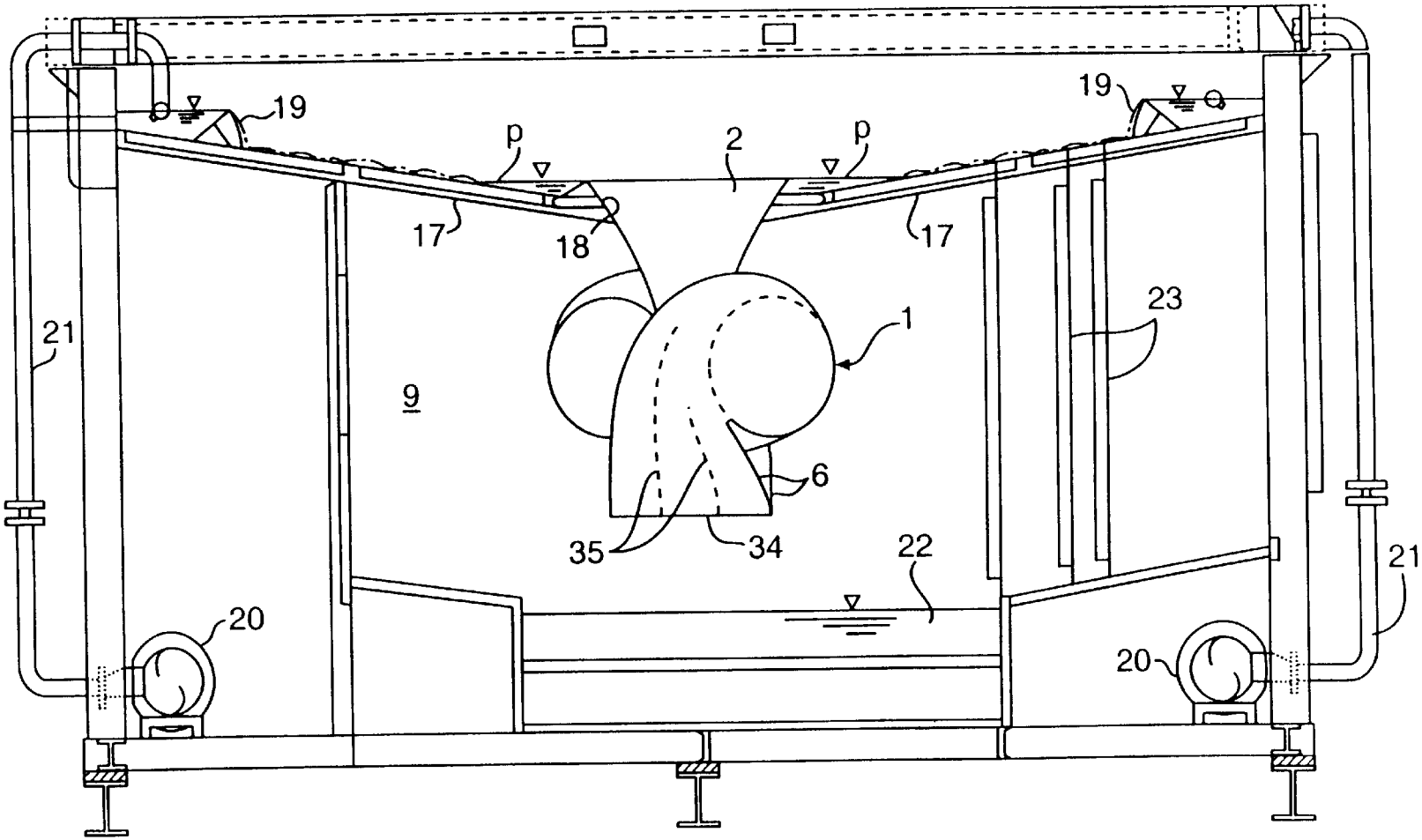
FIG. 10 is an enlarged view of the inside of a scrubber section including a modified wet scrubber of the first embodiment shown in FIG. 3.

FIG. 10 illustrates a modified wet scrubber 1. As shown in this figure, for the purpose of enhancing the pressure recovery in the flow deceleration taking place in the volutes before exiting the scrubber 1, the discharge volutes 6 may be provided with vanes 35. The discharge volutes 6 are in fact curved and short wide-angle diffusers that decelerate the flow by gradually increasing the effective flow area with a certain divergence angle. However, under certain conditions this increment may be excessive and the flow exiting the volutes (shown by arrows g in FIG. 9) may enter stalling conditions, thus becoming unstable and leading to additional pressure losses. The discharge volute vanes 35 smoothly guide the discharge flow through the volutes and divide the volutes into several passages with smaller divergence angles and smaller flow area increments. Therefore, by adding vanes to the discharge volutes 6, the possibility of turbulent stalling is greatly reduced, the discharge flow (arrows g) is stabilized, and the deceleration is more efficient. All these translate into a more efficient recovery in static pressure. Volutes with vanes 35 may be about two times more efficient recovering static pressure than vaneless volutes, besides the fact that the exit flow is more stable.

It is commonly accepted that, among particles in a paint mist, large particles of 40 $\mu$m or more in diameter are easy to collect while particles of 5 $\mu$m or less in diameter are difficult to collect. For the purpose of improving the capturing of smaller particles contained in the discharge airflow, the wet scrubber according to the present invention may be further provided with means to increase the effective paint particle diameter before it enters the scrubber or while in the scrubber.

Figure 11:
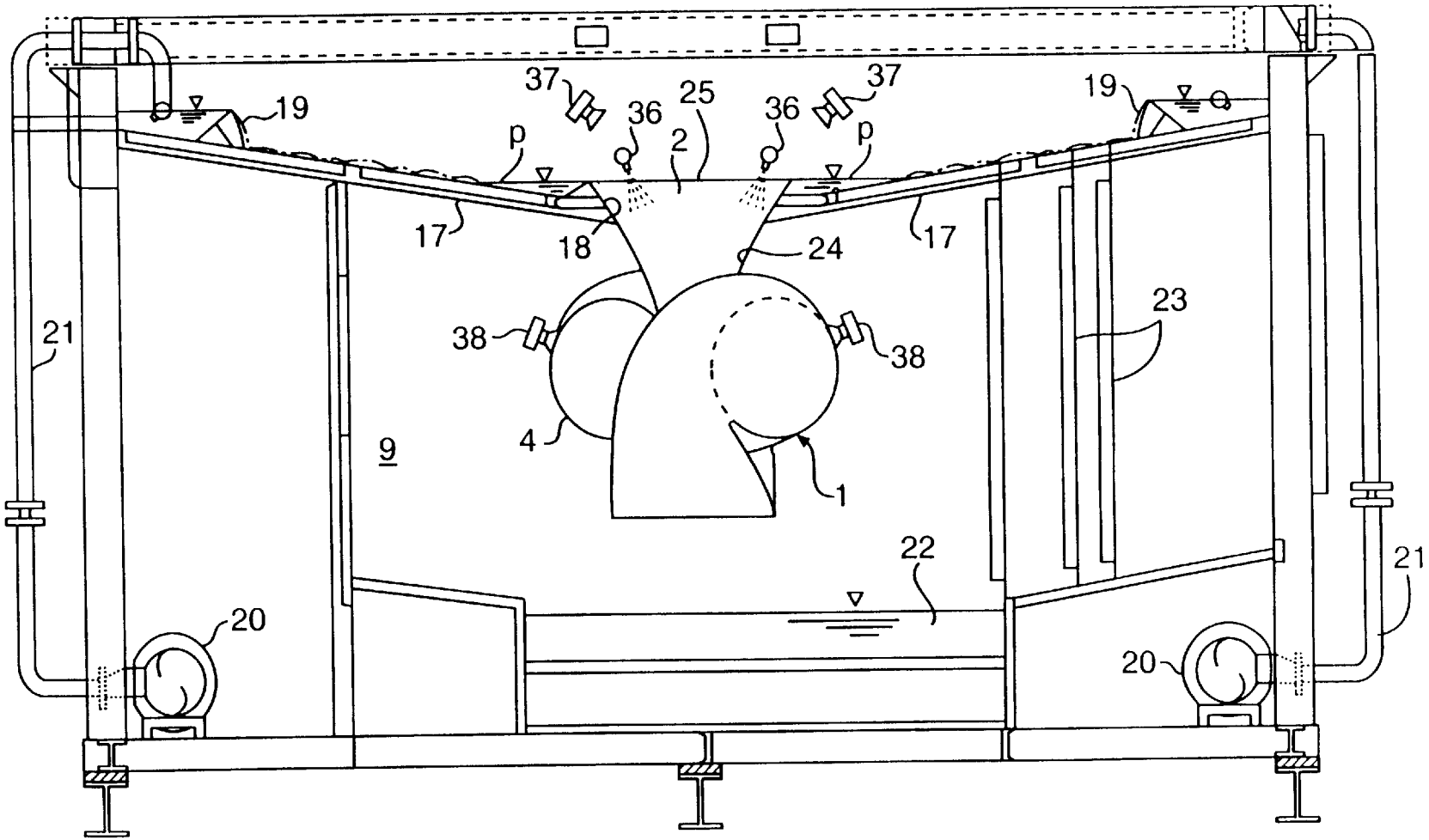
FIG. 11 is an enlarged view of the inside of a scrubber section including another modified wet scrubber of the first embodiment shown in FIG. 3.

To this respect, FIG. 11 illustrates a modified wet scrubber 1. As embodied herein, water spray nozzles 36 are positioned slightly above the inlet 25 of the acceleration cone 2 facing the inner peripheral wall 24. Based on the fact that for a given amount of water the contact area between the water drops and the paint mist contained in the air increases proportionally with the inverse of the water drop diameter, the wet scrubber 1 is supplemented with water spray nozzles 36 to generate a dense population of small water droplets at the inlet of the acceleration cone. This is essentially a mean to precondition the discharge airflow e and to start the capturing process even before the air stream enters the wet scrubber 1. The preconditioning occurs as follows. The water drops sprayed toward the discharge airflow e (FIG. 9) collide with some of the paint particles in the air stream and coalesce with them forming particles of bigger effective diameter, which will be easier to trap in the wet scrubber 1. The finely broken-up water droplets injected by the nozzles 36 will also enhance the collision and coalescence process promoted by the turbulence of the high-speed flow at the outlet 26 of the acceleration cone 2 and the adjusting plates 29 (FIG. 6). Without these water spray nozzles 36, the collision and coalescence process at the end of the cone, relies mainly in the strength of the high turbulent shear to break-up the water film a to form a dense water curtain b, which as described previously provides an important capturing media in the mixing chamber 3. Thus, the spray nozzles 36 serve to facilitate further the capturing of these paint particles contained in the discharge air.

FIG. 11 illustrates also another mean to increase the effective particle diameter. As embodied herein the wet scrubber 1 can be further supplemented with ultrasonic (higher than 20 kHz) wave generators 37 positioned slightly above the acceleration cone inlet and/or ultrasonic wave generators 38 attached to the surface of the vortex chambers 4 and/or residence cylinders 5 and operated from outside the scrubber. Although the principle is the same, ultrasonic wave generators 37 and 38 work differently. Ultrasonic standing waves of a fixed frequency, a sweep of several frequencies around a controlled central frequency, or several simultaneous frequencies, can be emitted by the wave generators 37 located above the cone inlet. These ultrasonic waves increase the effective size of small paint particles, contained in the discharge airflow e coming from the spraying section 8, by making them migrate from the anti-nodes of the sound pressure waves to the nodes, where they collide with each other and agglomerate every half wavelength in a process known as sonic agglomeration. The restriction that the affected particle has to be much smaller than the wavelength to agglomerate, provide a means of discriminating the range of paint particle sizes affected by simply adjusting the wave frequency. For example, paint particles of 5 $\mu$m or less in diameter contained in the paint mist can be pretreated to promote agglomeration and thus facilitate their capturing in the wet scrubber 1. Further, with the ultrasonic wave generator 37, even sub-micron particles can be agglomerated to increase the effective particle diameter and to allow the above described scrubber 1 to perform the capturing with ease. Therefore, the ultrasonic wave generators 37 enhance the capturing of paint particles entrained in the discharge air.

Additionally, as depicted in FIG. 11, ultrasonic wave generators 38 can be attached to the surface of the vortex chambers 4 and the residence cylinders 5. The generated -standing sound waves of a fixed frequency, a sweep of several frequencies around a controlled central frequency, or several simultaneous frequencies, emitted by ultrasonic generators 38 inside the mixing and vortex chambers, 3 and 4 respectively, will enhance capturing by using the forces generated by the sound pressure waves to perturb and agglomerate hard-to-capture minute paint particles entrained in the air stream as well as to increase the frequency of collisions between the paint particles themselves and between the paint particles and the water droplets. These agglomerated bigger particles respond strongly to the inertia and centrifugal effects in the chambers 3 and 4, and are then easier to capture by the water inside the scrubber 1. Also, the frequency of the wave generators 38 can be adjusted such that the action of the pressure waves emitted may help to maintain the inner surfaces of the vortex chambers 4 and the residence cylinders 5 cleaner for a longer time. Therefore, the ultrasonic wave generators 38 enhance further the capturing of the paint particles in the air stream by the water inside the scrubber 1 and, by keeping the inner surface of the vortex chamber and the residence cylinder cleaner for a longer time, provide a saving in maintenance costs.

Embodiment 2

Figure 12:
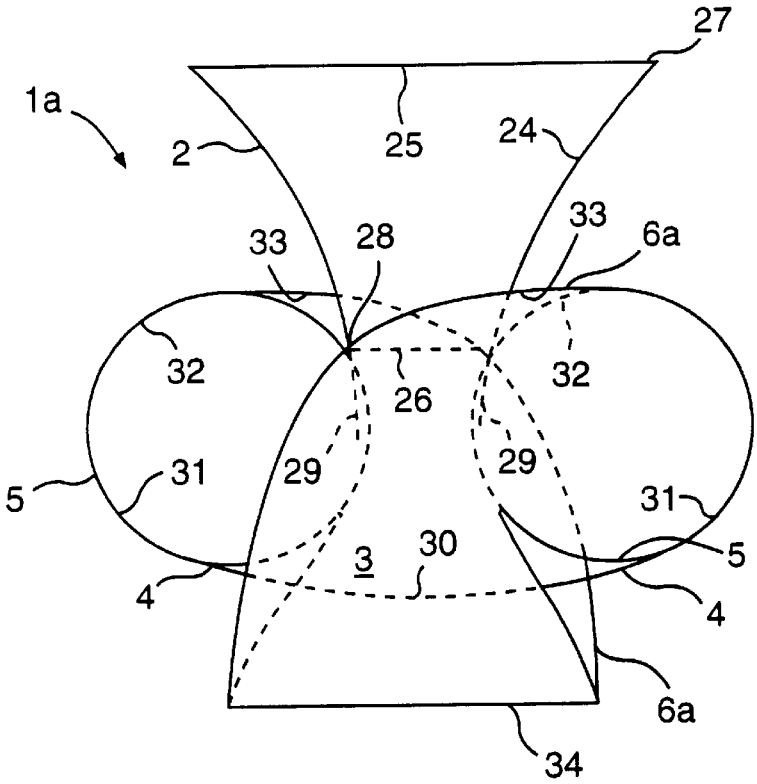
FIG. 12 is a front elevation view of a wet scrubber in accordance with a second embodiment of the present invention.
Figure 13:
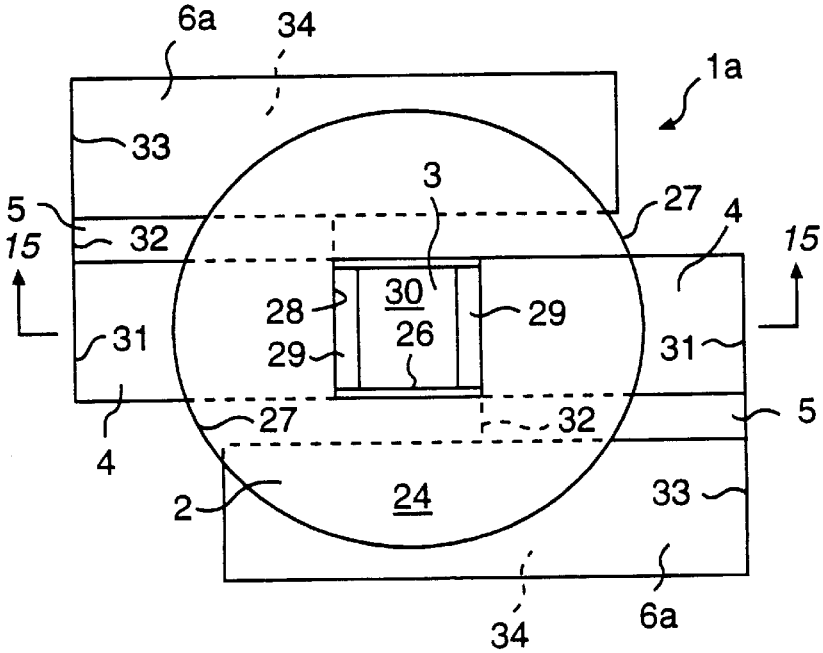
FIG. 13 is a plan view of the wet scrubber shown in FIG. 12.
Figure 14:
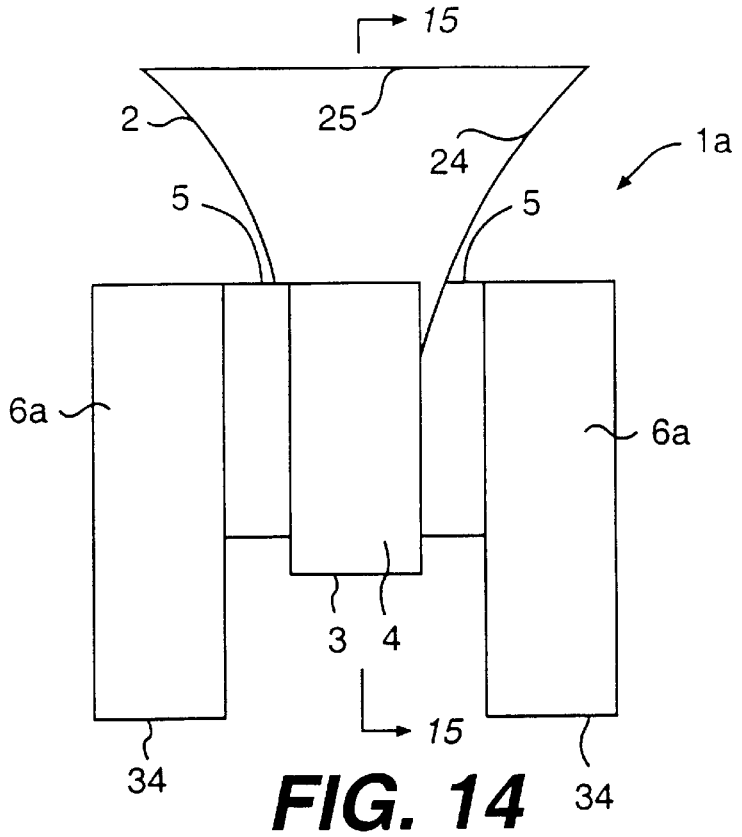
FIG. 14 is a side elevation view of the wet scrubber shown in FIG. 12.
Figure 15:
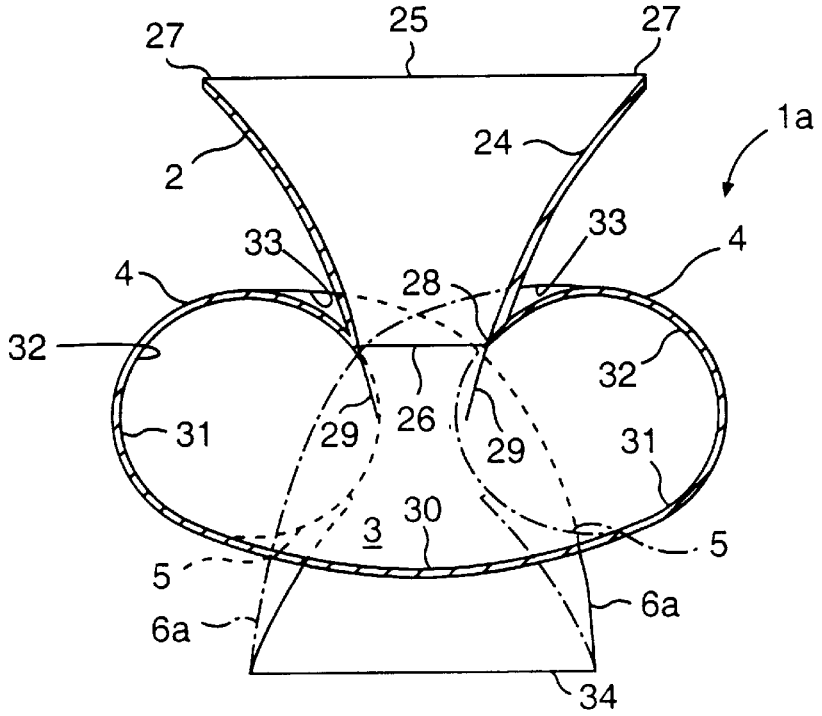
FIG. 15 is a sectional view of the wet scrubber taking along line 15—15 of FIGS. 13 and 14.

FIGS. 12 to 15 illustrate a second embodiment of a wet scrubber 1*a,* constructed in accordance with the present invention. FIGS. 12, 13, and 14 are a front elevation, a plan view, and a side elevation of the wet scrubber 1*a,* respectively, and FIG. 15 illustrates a sectional view of the wet scrubber 1*a* taking along the line 15—15 of FIGS. 13 or 14. As can be seen from these figures, the present wet scrubber 1*a* is constructed in a similar manner to that of the wet scrubber 1 of the first embodiment, but has been modified in the structure of the discharge volutes 6*a.*

In this second embodiment, although the inner wall surfaces 33 of the right and left discharge volutes 6*a* still have a spiral-type shape, the curved surfaces 33 do not exceed the highest part of the inner wall surfaces 32 of the residence cylinders 5. Preferably, the height of the highest part of the inner wall surfaces 33 of the discharge volutes 6*a* is the same as that of the highest part of the inner wall surfaces 31 of the vortex chambers 4, and the same as that of the highest part of the inner wall surfaces 32 of the residence cylinders 5. During operation of wet scrubber 1*a* in a paint spray booth 10, due to the centrifugal force generated by the swirling flow, a water film flows on the inner wall surfaces 31 of the vortex chambers 4, on the inner wall surfaces 32 of the residence cylinders 5, and on the inner wall surfaces 33 of the discharge volutes 6.

In the event the centrifugal force of the swirling air and water is relatively weak, there is concern that the water will not smoothly flow over the whole inner wall surfaces 33 of the discharge volutes 6 of the first wet scrubber embodiment (FIG. 9). Paint particles contained in the water may attach to the inner wall surfaces 33 of the discharge volutes 6, and, as a result, cleaning of the wet scrubber 1, particularly the inside of the discharge volutes 6, may be required.

On the other hand, in wet scrubber 1*a,* due to the height limitation of the inner wall surfaces 33 of the discharge volutes 6*a,* even if the centrifugal force of the swirling air and water stream is weakened, the water will smoothly flow over the whole inner wall surfaces 33 of the discharge volutes 6*a*. The possibility that paint particles might stick on the inner wall surfaces 33 of the discharge volutes 6*a* is reduced, and, thus, the need for frequent cleaning of the wet scrubber 1*a,* particularly the inside of the discharge volutes 6*a,* is eliminated.

At the portion communicating with the residence cylinders 5; the inner wall surfaces 33 of the discharge volutes 6*a* have a curvature corresponding to that of the inner wall surfaces 32 of the residence cylinders 5. Thus, the inner wall surfaces 33 of the discharge volutes are in perfect alignment with the inner wall surfaces 32 of the residence cylinders 5, providing unimpeded continuity to the swirling flow.

The shape of the inner wall surfaces 33 of the discharge volutes 6*a* is such that the air streams, swirling out of the residence cylinders 5 are decelerated and discharged through the discharge ports 34 at a speed of about 10 m/s or less.

Embodiment 3

Figure 16:
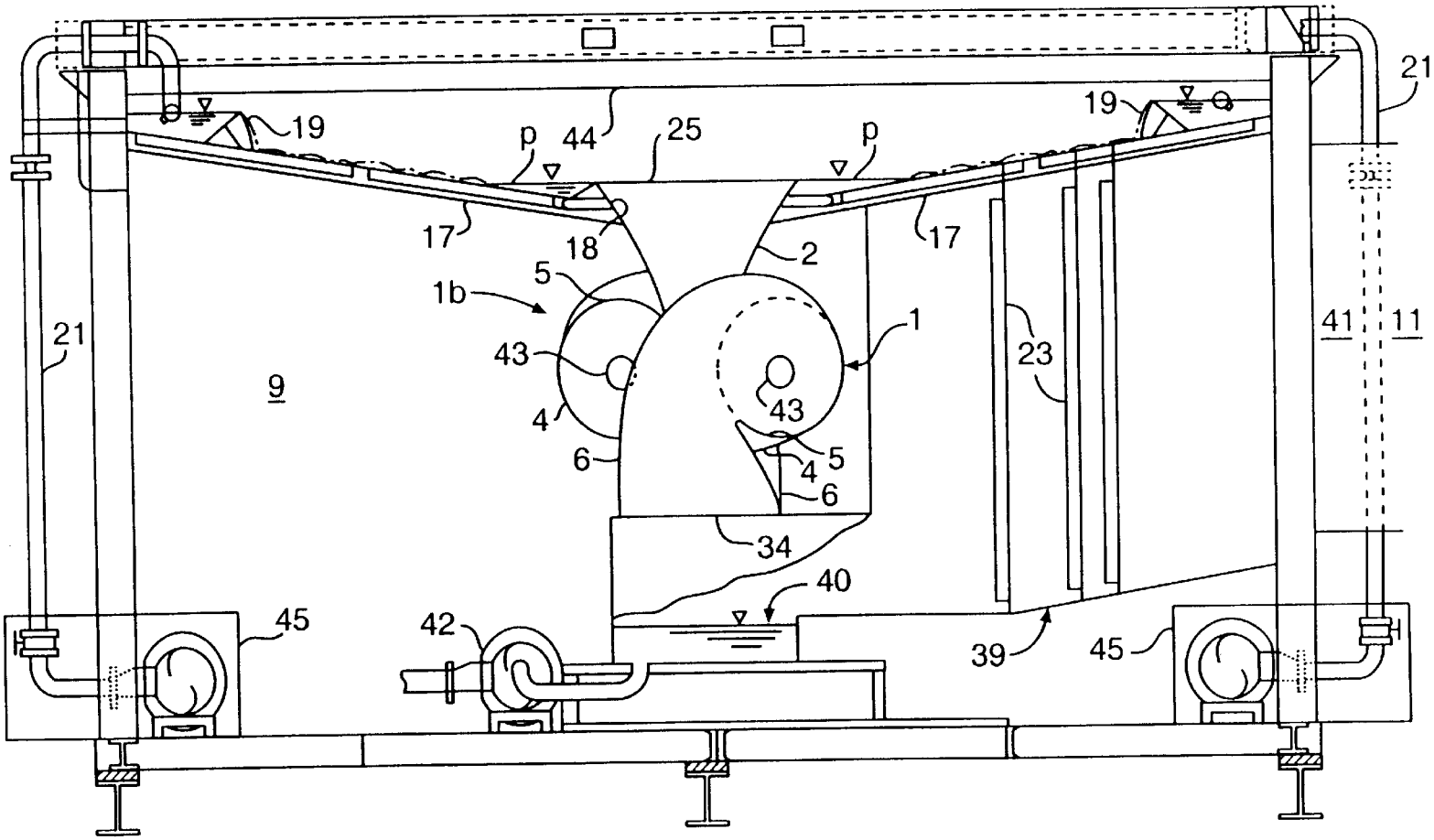
FIG. 16 is an enlarged view of the inside of a scrubber section including a wet scrubber, in accordance with a third embodiment of the present invention.

FIG. 16 displays an enlarged view of the inside of a scrubber section 9 constructed in accordance with the present invention. Comparing this figure with FIG. 2, the wet scrubber 1*b* of this embodiment is seen to be similar to the wet scrubber 1 of Embodiment 1 with respect to the acceleration cone 2, the mixing chamber 3, the vortex chambers 4, the residence cylinders 5 and the discharge volutes 6. However, in accordance with the invention, the scrubber section now connects to a confined exhaust air chamber.

As embodied herein, the exhaust air chamber 39 is positioned below the right and left discharge volutes 6 such that it communicates with the discharge port 34 of these discharge volutes 6. The connection between the discharge volutes 6 and the exhaust air chamber 39 is perfectly sealed to prevent fluids from escaping and vacuum noise from generating, and to allow an operator to come close to the scrubber 1*b* during regular booth operation. On the other end, the exhaust air chamber 39 is connected to the exhaust air duct 41 of the paint booth 10. Accordingly, when the paint spray booth is in operation, the exhaust air stream exiting from the discharge volutes 6 is drawn through the exhaust air chamber 39 and through the exhaust air duct 41 by the exhaust air fan 11 (not shown). The mist separators 23 in the chamber 39 collect paint particles and water drops that might not have been captured at prior stages. The bottom of the exhaust air chamber 39 is attached to a confined sludge drain 40, for collecting water and paint sludge flowing out of the right and left discharge volutes 6 of the wet scrubbers 1*b*. The individual confined drains 40 are connected to a sludge pump 42, to dispose the accumulated sludge from the drains 40. Either a sludge pump 42 for each drain 40 or a sludge pump 42 for several drains 40 may be provided.

Additionally, the flat walls of the vortex chambers and the discharge volutes are provided with inspection windows 43, which allow an operator to visually inspect the inside of the scrubber 1*b*, even during operation. These inspection windows 43 help operators to plan when the next maintenance procedure should be scheduled. Also, because of the easy access, an operator can independently tilt the nozzle adjusting plates 29 (FIG. 3) of each scrubbers 1*b* to control the speed of the impinging discharge air jet e' (FIG. 9) exiting the lower end of the acceleration cone 2 toward the water pool in the mixing chamber 3 (FIG. 3). Tilting the nozzle plates 29 have a direct influence on the capturing performance of the wet scrubber 1*b* and in the pressure drop through it.

The paint spray booth is preferably provided with a plurality of wet scrubbers 1*b* disposed in the scrubber section 9 in a longitudinal direction at substantially regular intervals. The flow plate 17 of the current embodiment is separated in sections by short vertical separators 44 placed transversally across the flow plate 17. Individual water regulating systems 45 for each wet scrubber 1*b* are also provided. The combination of the separators 44 and the water regulating systems 45 provide the capability to isolate and control independently the amount of water supplied to each individual scrubber 1*b*. On the other hand, the wet scrubbers 1*b* and their corresponding exhaust chambers 39 are formed separate from one another, so that the flow out of the right and left discharge volutes 6 of one wet scrubber 1*b* does not mix with the flow out of the discharge volutes of any other wet scrubber 1*b*. This separate type of construction permits an operator or an automatic control to tilt independently the nozzle adjusting plates 29 of scrubbers 1*b* to attain the required capturing performance in that particular longitudinal portion of the paint spray booth. Therefore, for a specified airflow or pressure drop through a particular section of the paint spray booth, by controlling the amount of water supplied and the angle of the nozzle adjusting plates 29, wet scrubbers 1*b* can be operated and adjusted independently of one another.

Embodiment 4

Figure 17:
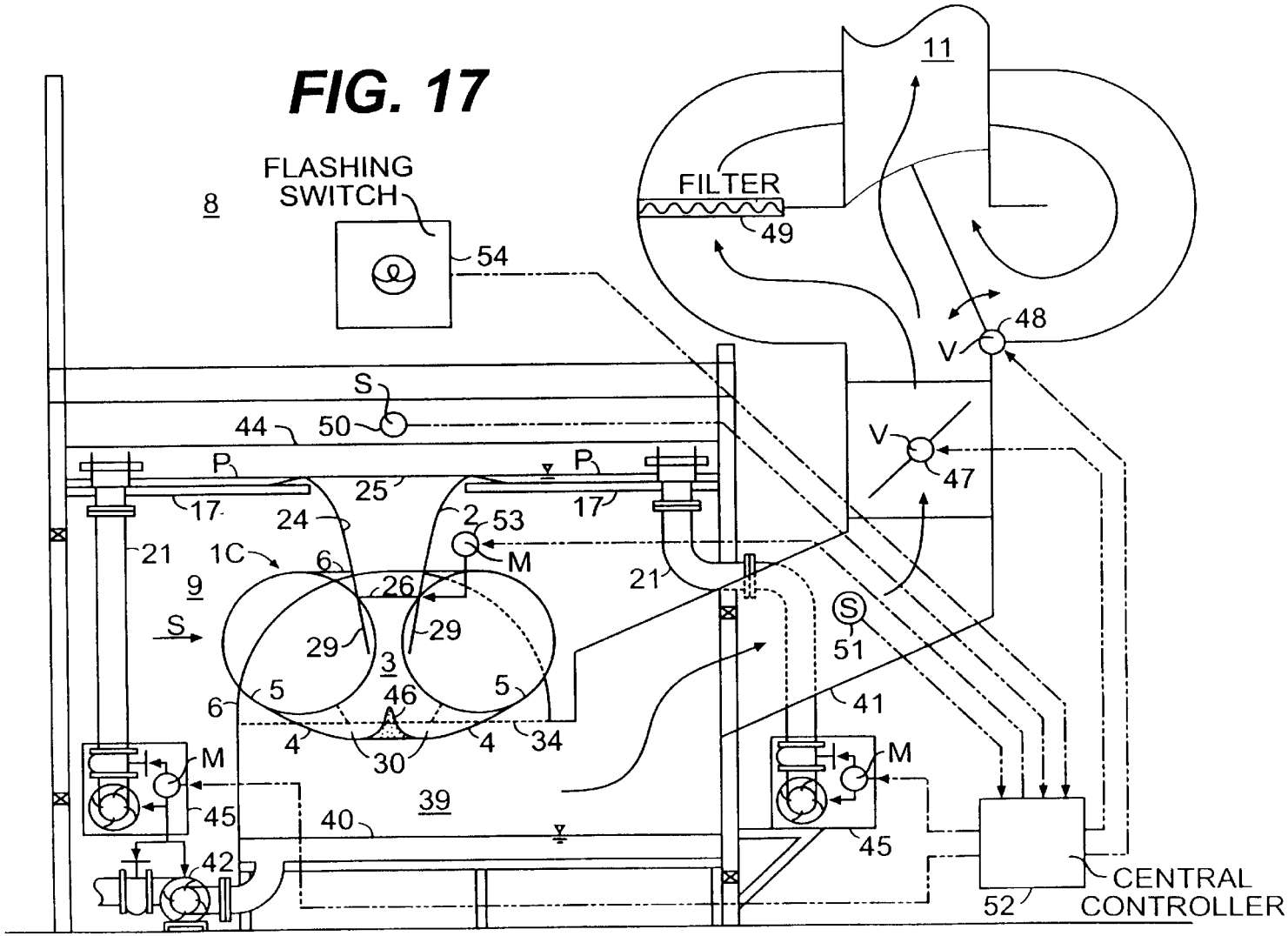
FIG. 17 is an enlarged view of the inside of a scrubber section including a wet scrubber in accordance with a fourth embodiment of the present invention.
Figure 18:
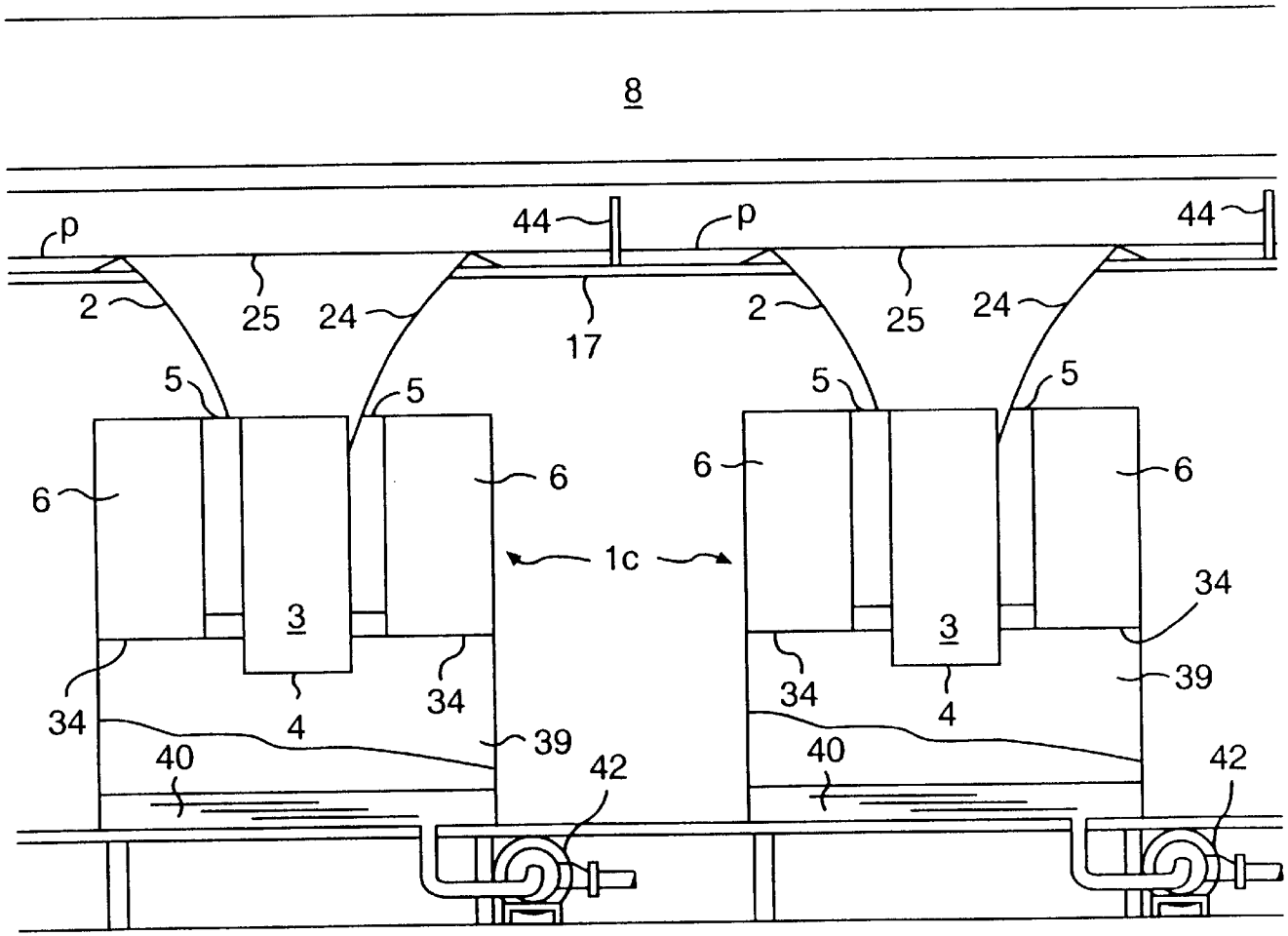
FIG. 18 is an elevation view of the major portion of a paint spray booth viewed from the direction of arrow S in FIG. 17, and showing two scrubbers arranged in tandem.

FIG. 17 is an enlarged view of the inside of a scrubber section 9 of a paint spray booth 10 constructed in accordance with the present invention. FIG. 18 is an elevation view of a portion of the paint spray booth 10 viewed from the direction of arrow S in FIG. 17, showing two scrubbers 1*c* arranged in tandem. As shown in these figures, the wet scrubber 1*c* of the present embodiment is constructed similarly to the wet scrubber 1*a* of Embodiment 2 (FIGS. 12–15), except that the overall height of the discharge volutes 6 have been reduced. The highest part of the inner wall surfaces 33 of the discharge volutes 6 is preferably no higher than the highest portion of the inner wall surfaces 31 of the vortex chambers 4 and the inner wall surfaces 32 of the residence cylinders 5, the same as shown in FIG. 12. In addition to this, in the scrubber 1*c* of the present embodiment these inner wall surfaces 33 of the volutes 6 are now elongated. As a result, corresponding elongated right and left discharge ports 34 are now provided. Nevertheless, water can smoothly flow over the whole inner wall surfaces of the discharge volutes 6, and, thus, the need for cleaning the inside of the discharge volutes 6 is unlikely or becomes rarely necessary.

In the present embodiment, as is shown in FIG. 17, a flow divider or splitter 46 is provided on the impingement pool 30 of the mixing chamber 3. Splitter 46 is in the general shape of an inverted "V" with flared legs such that the surfaces of the splitter 46 are in continuity with the impingement pool 30. The splitter 46 is positioned below and spans the distance across the outlet 26 of the cone 2. Discharge airflow and water introduced into the mixing chamber 3 are distributed evenly to the right and left vortex chambers 4 by splitter 46, and consequently, to the right and left residence cylinders 5 and discharge volutes 6. Accordingly, any problems due to uneven distribution of the airflow and the water to the right and left paths inside the scrubber can be prevented. Uneven stream distribution is immediately evidenced by a low rotational energy through one of the two symmetrical portions of the scrubber and may lead to paint sludge accumulation on the inner wall of the vortex chamber 4, the residence cylinder 5 or the discharge volute 6.

Similar to embodiment 3, in the current embodiment (FIGS. 17 and 18), a confined exhaust air chamber 39 is provided. This exhaust air chamber 39 is connected to the right and left discharge volutes 6 at one end, and to the exhaust air duct 41 of the paint spray booth 10, on the other end. The connection between the discharge volutes 6 and the exhaust air chamber 39 is perfectly sealed to prevent fluids from escaping and vacuum noise from generating, and to allow an operator to access the scrubber 1*c* during regular booth operation. The flow plate 17 of this embodiment is also separated in sections by short, transverse, vertical separators 44, and independent water regulating systems 45 are also provided. In addition to having mist separators 23 (not shown), the bottom of each exhaust air chamber 39 is attached to a respective sludge drain 40 for collecting water and paint sludge flowing out of the right and left discharge volutes 6 of the wet scrubbers. The sludge drain 40 is connected to a sludge pump 42, to dispose the accumulated sludge from the drain 40. A single sludge pump 42 may be connected to one or several drains 40. An exhaust air duct 41 is connected to the exhaust air fan 11 (not shown) and is preferably provided for each wet scrubber 1*c*. A second alternative is to provide an exhaust fan 11 for a group of wet scrubbers 1*c*, which can be accomplished by adding a manifold (not shown) or a small exhaust air plenum (not shown) where multiple exhaust air ducts 41 join.

Additionally, an opening and closing damper valve 47 is provided and inserted in each respective air exhaust duct 41. When a particular damper valve 47 is fully closed the exhaust fan 11 draws no air through the corresponding exhaust air chamber 39 and exhaust air duct 41. Further, a fast emergency valve 48 is provided, such that when activated the exhaust airflow is by-passed through a set of emergency filters 49.

The paint spray booth 10 is preferably provided with a plurality of wet scrubbers 1*c* disposed in the longitudinal direction at substantially regular intervals. As shown in FIG. 18, two wet scrubbers 1*c* are constructed and mounted independently of one another. Airflow that exits the right and left discharge volutes 6 of one wet scrubber 1*c* is not mixed with that exiting from the discharge volutes 6 of another wet scrubber 1*c*. As described earlier, this separate-type of construction permits control of the amount of water supplied and the independent tilting of the nozzle adjusting plates 29 of scrubbers 1*c* to accommodate the required capturing performance in that particular longitudinal portion of the paint spray booth 10. Moreover, by stopping the water supplied to the appropriate portion of the flow plate 17, stopping the corresponding sludge pump 42 and closing the corresponding damper valve 47, in the present embodiment, a wet scrubber 1*c* and its corresponding exhaust air chamber 39 can be isolated, repaired and maintained independently of one another. This whole repair and maintenance process can be carried out while the rest of the paint spray booth 10 remains fully operational.

The independent-type of construction of the present invention permits the implementation of a control system. Therefore, in accordance with the invention, an automatic control system for the operation of the wet scrubber is provided based on any paint particles remaining in the processed exhaust airflow and in the presence of particles to be captured at the inlet of the scrubbing section. As embodied herein and shown in FIG. 17, an inlet sensor 50, for detecting the presence of paint mist to be scrubbed in the discharge air flowing down of the spray section, is mounted above the flow plate 17. Additionally, an exhaust sensor 51, for detecting the amount of particles in the exhaust airflow, is mounted in the exhaust air duct 41. A central controller 52 is connected to the output of the inlet sensor 50 and the exhaust sensor 51. The central controller 52, in turn, is connected to the water regulating system 45 for adjusting the amount of water supplied to the gutters and, thus, to the flow plate 17, and for activating the sludge pump 42, if appropriate. The central controller 52 is also connected to a tilting mechanism 53 activated to slant the pair of nozzle adjusting plates 29. Tilting the nozzle plates 29 controls the speed of the impinging discharge air jet e' (FIG. 9) exiting the lower end of the acceleration cone 2 toward the water pool in the mixing chamber 3, and has a direct influence on the capturing performance of the wet scrubber 1*c* and in the pressure drop through it. Thus, based on the signals generated by the corresponding sensors 50 and 51, the central controller unit 52 determines the amount of water to be supplied to the flow plate 17 and the degree of opening of the pair of adjusting plates 29. Next, it sends the proper actuating signals to the water regulating system 45 and the tilting mechanism 53.

An important feature of this embodiment is that the central controller 52 continuously monitors the amount of paint particles coming down from the spray section, using the inlet sensor 50, and the amount of particles exiting with the exhaust stream, using exhaust sensor 51. With this information, the central controller 52 can adjust the wet scrubber system for optimal performance. Also, because the wet scrubbers 1*c* are operated independently of one another, automatic control can be carried out with regard to the respective wet scrubbers 1*c* independently of one another where each has its own enclosed exhaust air chamber 39. Thus, each scrubber system would contain an inlet sensor 50, an exhaust sensor 51, a central controller 52, a local water regulating system 45, and a tilting mechanism 53 connected and operated as just described. In the following, the control operations are described during the different operating conditions of the scrubber system. During regular booth operation, the control system works using the "normal operation" routine. At this stage, the exhaust sensor 51 continuously determines the amount of fugitive particles in the exhaust air stream. It then sends a signal to the central controller unit 52. The central controller then compares the amount of particles escaping with the expected target set by the operator and determines the proper actions to take to meet the goal. It then sends actuating signals to the water regulating system 45 and the tilting mechanism 53. This process is repeated continuously to keep the scrubber performance as close as possible to the target.

When for some reason the painting operation, in the corresponding booth section, stops temporarily, the inlet sensor 50 will detect that no entrained particles have been released to the discharge air coming down from the spray section and will start sending a "no-paint" signal to the controller 52. The central controller 52 receives the signal and starts a "no-paint timer" count. This timer will run as long as the "no-paint" signal from the inlet sensor 50 remains. The controller 52 compares the time in the timer with the specified "no-paint time limit". If the "no-paint timer" time is greater than or equal to the "no-paint time limit", the controller 52 sends a "relax" command with appropriate actuating signals to open the nozzle adjusting plates 29 and to reduce the amount of water supplied to the flow plate 17 as well as to reduce the amount of sludge pumped out of the drains 40.

The delay between this "no-paint" signal and the "relax" command, set by the "no-paint time limit", is necessary to prevent the controller 52 from giving frequent "relax" commands for trivial stops, as when the painting process stops between one car body and the next. The operator can set this "no-paint time limit" according to preference or experience. The "relax" command can have important implications in the operational costs of the paint spray booth. In particular, opening the adjusting plates will minimize pressure drop through the wet scrubber 1*c*, while reducing the amount of supplied water will save in water-pumping costs and water-treatment costs. Therefore, when a portion of the paint spray booth is in idle condition, the control system of the present embodiment will minimize the operational costs of that section in particular, which allows a more efficient use of the energy resources.

As soon as the painting operation in the section is restored, the inlet sensor 50 sends a "paint" signal to the controller. The central controller 52 then enters the "default" stage. In the "default" stage the controller 52 resets the "no-paint timer", starts the "default timer" count and commands the tilting mechanism 53 to close the nozzle gap to its "default" condition and the water regulating system 45 to increase the water supply flow and the sludge pumping to its "default" level. The system remains in the "default" stage until the "default timer" reaches the specified "default time limit". After this, the central controller 52 sets the system in the "normal operation" stage and as explained before uses the signal of the exhaust sensor 51 to determine the necessary adjustments in the regulating mechanisms 45 and 53 to bring the performance of the scrubber 1*c* to its optimal peak. These "default" values for the actuating mechanisms 45 and 53 are set in advance and re-calibrated periodically by an operator to resemble the customary optimal operation conditions of the scrubber 1*c*. Similarly, the operator should decide an appropriate value for the "default time limit". The "default" values avoid control transients and bring the system as quickly as possible to the "normal operation" stage. For this reason, the "default" routine is used also when the scrubber system is first started.

However, because no control system responds immediately and giving the distance between the paint spray nozzles in the spray section and the inlet sensor 50, even using the "default" routine, a delay in the response of the control system is expected. If the scrubber system has been in the "relax" condition and the spray painting suddenly begin, this delay may lead to a batch of particles escaping the wet scrubber 1*c* and reaching the atmosphere. To avoid this, restoring switches 54 are provided such that the spraying personnel can manually restore the central controller 52 to its "default" condition before the spray painting operation begins. The restoring switches 54 will flash until the "default timer" reaches the "default time limit" to indicate to the spraying personnel that the painting process may be re-started.

In case a spraying operator forgets to hit a restoring switch 54 or did not wait for the flashing signal to stop before starting again the spray painting process, it is possible that a batch of poorly scrubbed exhaust air containing a substantial amount of fugitive paint particles may reach the exhaust sensor 51 while the system has not had time to completely come out of the "relax" stage. Although the amount of paint released in this short period of time may not be significant, the control system may be further provided with a fast emergency valve 48 and an emergency filter 49 to prevent any batch of fugitive particles to reach the atmosphere. The control routine is as follows. As soon as the inlet sensor 50 detects that there is paint entrained in the discharge air it sends a "paint" signal to the controller 52, which set the system in the "default" stage if it has not been set previously by a restoring switch 54. If the exhaust sensor 51 detects a fugitive batch, it sends a signal to the controller 52, which determines that the "default timer" still has not reached the "default time limit". This information tells the controller 52 that the painting activity has been restored but the scrubbing 1*c* system has not yet had time to adapt. The controller 52 then commands the fast emergency valve 48 to close, bypassing the exhaust airflow through the filter 49. After the "default time limit" has been reached and if the signal of the exhaust sensor 51 has been restored to normal range, the controller 52 determines that the emergency is over. It then commands the emergency valve 48 to open and the normal exhaust flow path is restored. The filter 49 provided is supposed to be used only during short periods of time in the eventuality of an emergency, so its life span is expected to be very long. If, on the contrary, after the "default time limit" has been reached, the signal of the exhaust sensor 51 has not been restored to normal range, the controller 52 emits an "alert" signal to tell the operator that something is wrong with that particular scrubber 1*c*. While this "alert" signal is on, the exhaust flow continues to be bypassed through the emergency filter 49. During this time the controller 52 continues to monitor the signal of the exhaust sensor 51, but the operator must reset the "alert" signal. Before restoring the system to normal stage, the operator should verify that the particular scrubber is operating normally. In addition, the controller 52 will display the status of the exhaust signal 51 to assist the operator in this task.

What is claimed is:

1. A control system for controlling the scrubbing of particles from an airflow comprising:

a) at least one wet scrubber to which liquid and the airflow is applied, for scrubbing particles from the airflow, and having an input and an output;

b) a first sensor for detecting particles in the airflow at the input of the wet scrubber;

c) a second sensor for detecting particles at the output of the wet scrubber, d) a controller for receiving the outputs of the first and second sensors to monitor the amount of particles detected at the input and output of the wet scrubber;

e) a liquid regulator responsive to the controller for adjusting the amount of liquid applied to the input of the wet scrubber; and f) adjusting means in the wet scrubber responsive to the controller for controlling the velocity of the airflow through the wet scrubber.

2. A control system as claimed in claim 1, wherein the controller compares the amount of particles detected by the second sensor at the output of the wet scrubber with a predetermined level and signals the liquid regulator to adjust the quantity of liquid applied to the wet scrubber as a result of the comparison, and signals the adjusting means to adjust the velocity of the airflow through the wet scrubber as a result of the comparison.

3. A control system as claimed in claim 1, wherein the controller determines the absence of particles detected at the first sensor and, after a preset time interval, signals the liquid regulator to reduce the quantity of liquid applied to the input of the wet scrubber, and signals the adjusting means to decrease the maximum airflow velocity through the wet scrubber so that the wet scrubber assumes an idling condition.

4. A control system as claimed in claim 1, wherein the adjusting means includes tiltable plates mounted in the airflow in the wet scrubber and whose angular position in the airflow is set by the controller to control the velocity of the airflow through the wet scrubber.

5. A control system as claimed in claim 4, further comprising an enclosed exhaust air chamber connected to the wet scrubber at its output, and an exhaust mechanism in communication with the enclosed exhaust air chamber for drawing the airflow through the wet scrubber.

6. A control system as claimed in claim 5, further comprising a drain positioned at the bottom of the enclosed exhaust air chamber for collecting liquid and sludge from the output of the wet scrubber, and a sludge pump responsive to and activated by the controller for disposing of liquid and sludge from the drain.

7. A control system as claimed in claim 5, wherein the exhaust mechanism includes an exhaust duct connected to the enclosed exhaust air chamber for carrying away scrubbed air, a bypass duct connected to the exhaust duct, a filter in the bypass duct, and a valve responsive to the controller positioned in the exhaust duct to divert airflow through the bypass duct and filter during conditions where the particles detected at the second sensor at the output of the wet scrubber are at an unacceptable level.

8. A control system as claimed in claim 3, further comprising a manual switch for restoring the controller to an operating condition.

9. A control system for controlling the scrubbing of particles from an airflow comprising:

a) at least one wet scrubber to which liquid and the airflow is applied, for scrubbing particles from the airflow, and having an input and an output;

b) a sensor for detecting particles at the output of the wet scrubber;

c) a controller for receiving the outputs of the sensor to monitor the amount of particles detected at the output of the wet scrubber;

d) a liquid regulator responsive to the controller for adjusting the amount of liquid applied to the input of the wet scrubber; and e) adjusting means in the wet scrubber responsive to the controller for controlling the velocity of the airflow through the wet scrubber.

10. A control system as claimed in claim 9, wherein the adjusting means includes tiltable plates mounted in the airflow in the wet scrubber and whose angular position in the airflow is set by the controller to control the velocity of the airflow through the wet scrubber.

11. A control system as claimed in claim 9, wherein the controller compares the amount of particles detected by the sensor at the output of the wet scrubber with a predetermined level and signals the liquid regulator to adjust the quantity of liquid applied to the wet scrubber as a result of the comparison, and signals the adjusting means to adjust the velocity of the airflow through the wet scrubber as a result of the comparison.

12. A control system as claimed in claim 10, further comprising an enclosed exhaust air chamber connected to the wet scrubber at its output, and an exhaust mechanism in communication with the enclosed exhaust air chamber for drawing the airflow through the wet scrubber.

13. A control system as claimed in claim 10, further comprising a drain positioned at the bottom of the enclosed exhaust air chamber for collecting liquid and sludge from the output of the wet scrubber, and a sludge pump responsive to and activated by the controller for disposing of liquid and sludge from the drain.

14. A control system for controlling the scrubbing of paint particles from discharge air in the scrubber section of a paint spray booth, comprising:

a) a plurality of wet scrubbers spaced at intervals in the scrubber section of the paint spray booth for scrubbing paint particles in the discharge air during paint spraying, each wet scrubber having an inlet for receiving discharge air and an outlet;

b) an enclosed exhaust air chamber connected to each wet scrubber at its outlet;

c) a first sensor at the inlet of each wet scrubber for detecting paint particles in the discharge air;

d) a second sensor at the respective outlet of each wet scrubber for detecting paint particles in the exhaust air;

e) a controller associated with each wet scrubber for receiving the outputs of the respective first and second sensors of the associated wet scrubber to monitor the amount of paint particles at the inlet and outlet of the associated wet scrubber;

f) a water regulator for each wet scrubber responsive to the associated controller for adjusting the quantity of water applied to the inlet of the associated wet scrubber;

g) adjusting means in each wet scrubber responsive to the associated controller for controlling the velocity of the discharge air through the associated wet scrubber;

and h) an exhaust air duct connected to each enclosed exhaust air chamber, for exhausting scrubbed air from the paint spray booth;

I) whereby each controller controls the quantity of water applied by the responsive water regulator to the inlet of the associated wet scrubber and the velocity of the discharge air by adjustment of the responsive adjusting means.

15. A control system as claimed in claim 14, wherein each controller compares the amount of particles detected by the respective second sensor at the outlet of the associated wet scrubber with a predetermined level and signals the responsive regulator to adjust the quantity of water applied to the wet scrubber as a result of the comparison, and signals the responsive adjusting means to adjust the velocity of the airflow through the wet scrubber as a result of the comparison.

16. A control system as claimed in claim 14, wherein each adjusting means includes tiltable plates mounted in the airflow in the associated wet scrubber and whose angular position in the airflow is set by the responsive controller to control the velocity of the airflow through the associated wet scrubber.

17. A control system as claimed in claim 16, wherein each wet scrubber includes an enclosed exhaust air chamber connected thereto at its outlet, and an exhaust mechanism in communication with the enclosed exhaust air chamber for drawing the airflow through the associated wet scrubber.

18. A control system as claimed in claim 17, wherein each enclosed exhaust air chamber has a drain positioned at its bottom for collecting liquid water and sludge from the outlet of the associated wet scrubber, and a sludge pump responsive to and activated by the associated controller for disposing of water and sludge from the drain.

19. A control system as claimed in claim 17, wherein each exhaust mechanism includes an exhaust duct connected to the respective enclosed exhaust air chamber for carrying away scrubbed air, a bypass duct connected to the exhaust duct, a filter in the bypass duct, and a valve responsive to the associated controller positioned in the exhaust duct to divert airflow through the bypass duct and filter during conditions where the particles detected at the second sensor at the outlet of the associated wet scrubber are at an unacceptable level.

20. A control system as claimed in claim 14, wherein each controller determines the absence of particles detected at the associated first sensor and, after a preset time interval, signals the responsive water regulator to reduce the quantity of water applied to the inlet of the associated wet scrubber, and signals the responsive adjusting means to decrease the maximum airflow velocity through the associated wet scrubber so that the wet scrubber assumes an idling condition.

21. A control system as claimed in claim 20, further comprising a manual switch connected to each controller for restoring the controller to an operating condition.

22. A control system as claimed in claim 14 wherein each wet scrubber is connected to operate independently of the other wet scrubbers thereby to permit repair or maintenance of one or more wet scrubbers while the other wet scrubbers remain operational.

* * * * *

UNITED STATES PATENT AND TRADEMARK OFFICE

CERTIFICATE OF CORRECTION

PATENT NO. : 6,093,250
DATED : July 25, 2000
INVENTOR(S) : Abraham J. Salazar, Kozo Saito and Richard P. Alloo It is certified that error appears in the above-identified patent and that said Letters Patent is hereby corrected as shown below:

Title page,
Item [73], assignee, line 3, after "Manufacturing,", insert -- North America, --.

Signed and Sealed this

Sixteenth Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,093,250 
DATED : July 25, 2000
INVENTOR(S) :Abraham J. Salazar, Kozo Saito and Richard P. Alloo It is certified that error appears in the above-identified patent and that said Letters Patent is hereby corrected as shown below:

Title page,
Item [75], in the Inventors, after "Lexington, Ky.", delete "; Naoji Tanaka, Toyota, Japan".

Signed and Sealed this

Eleventh Day of March, 2003

JAMES E. ROGAN
*Director of the United States Patent and Trademark Office*